US006483997B1

(12) United States Patent
Nakazato

(10) Patent No.: US 6,483,997 B1
(45) Date of Patent: Nov. 19, 2002

(54) IMAGE FORMING APPARATUS AND METHOD FOR ELECTRIFYING AND DEVELOPING BIAS CONTROL FEATURES

(75) Inventor: Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/625,056

(22) Filed: Jul. 24, 2000

(30) Foreign Application Priority Data

Jul. 28, 1999 (JP) ..... 11-213655

(51) Int. Cl.[7] ..... G03G 15/00
(52) U.S. Cl. ..... 399/46; 399/49; 399/72
(58) Field of Search ..... 399/46, 49, 50, 399/53, 72

(56) References Cited

U.S. PATENT DOCUMENTS

| | | | | |
|---|---|---|---|---|
| 5,124,750 A | * | 6/1992 | Naito | 399/55 |
| 5,298,944 A | * | 3/1994 | Sawayama et al. | 399/49 |
| 5,321,468 A | | 6/1994 | Nakane et al. | |
| 5,453,773 A | | 9/1995 | Hattori et al. | |
| 6,243,542 B1 | * | 6/2001 | Fujimoto et al. | 399/49 |

FOREIGN PATENT DOCUMENTS

| | | | |
|---|---|---|---|
| EP | 0 589 135 | | 3/1994 |
| JP | 63-142370 A | * | 6/1988 |
| JP | 63-142370 | | 6/1988 |
| JP | 3-260667 | | 11/1991 |
| JP | 4-30182 | | 2/1992 |
| JP | 4-96076 A | * | 3/1992 |
| JP | 4-96076 | | 3/1992 |
| JP | 4-204762 | | 7/1992 |
| JP | 5-40397 | | 2/1993 |
| JP | 5-40397 A | * | 2/1993 |
| JP | 5-333648 A | * | 12/1993 |
| JP | 5-333648 | | 12/1993 |
| JP | 6-102735 | | 4/1994 |
| JP | 8-211722 | | 8/1996 |
| JP | 244472 A | * | 9/1997 |
| JP | 9-244472 | | 9/1997 |
| JP | 10-55081 | | 2/1998 |
| JP | 10-55081 A | * | 2/1998 |
| JP | 10-239924 A | * | 9/1998 |
| JP | 10-239924 | | 9/1998 |
| JP | 11-15217 | | 1/1999 |
| JP | 11-15217 A | * | 1/1999 |
| JP | 11-133682 | | 5/1999 |
| JP | 3013441 | | 2/2000 |
| JP | 2000-66550 | | 3/2000 |
| JP | 3236751 | | 12/2001 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An engine controller adjusts an image density of the toner image to a target density by controlling an electrifying bias and a development bias. The engine controller determines an optimal development bias which is needed to obtain the target density based on densities of first patch images which are formed in the following bias condition: The electrifying bias is fixed at the most recent optimal electrifying bias which is stored in a RAM; and the development bias is gradually changing based on the most recent optimal development bias which is stored in the RAM.

18 Claims, 34 Drawing Sheets

IMAGE FORMING APPARATUS AND METHOD FOR ELECTRIFYING AND DEVELOPING BIAS CONTROL FEATURES

BACKGROUND OF THE INVENTION

1. Field of the Invention

The present invention relates to an image forming apparatus and an image forming method in which an electrifying bias applied to electrifying means electrifies a surface of a photosensitive member, an electrostatic latent image is thereafter formed on the surface of the photosensitive member, and a development bias is thereafter applied to developer means so that a toner visualizes the electrostatic latent image into a toner image.

2. Description of the Related Art

This type of an image forming apparatus often sees a change in an image density due to the following factors: fatigue, degradation with age or the like of a photosensitive member and a toner; a change in a temperature, a humidity or the like around the apparatus; and other causes. Noting this, a number of techniques have been proposed which aim at stabilizing an image density through appropriate adjustment of a density control factor such as an electrifying bias, a development bias, a light exposure dose, etc. For example, the invention described in the Japanese Patent Application Laid-Open Gazette No. 10-239924 requires to properly adjust an electrifying bias and a development bias in an effort to stabilize an image density. That is, according to this conventional technique, reference patch images are formed on a photosensitive member while changing an electrifying bias and/or a development bias and an image density of each reference patch is detected. An optimal electrifying bias and an optimal development bias are thereafter determined based on the detected image densities, and a density of a toner image is accordingly adjusted.

The density adjustment is executed at the following timing. Specifically, after turning on a main power source of the image forming apparatus, a density is adjusted upon arriving at a state where the apparatus is ready to form an image, which is when a fixing temperature reaches a predetermined temperature or immediately after that, for example. Where a timer is built within the image forming apparatus, the density adjustment is executed at regular intervals, e.g., for every two hours.

By the way, while an electrifying bias and a development bias change in accordance with fatigue, degradation with age or the like of a photosensitive member and a toner, etc., the changes possess a continuity to a certain extent. Hence, when repeated density adjustment is desired, if a density is adjusted using an optimal electrifying bias and an optimal development bias which are obtainable from immediately preceding density adjustment, the current density adjustment is expectedly more accurate.

However, according to this conventional technique, a density is adjusted uniformly at the timing described above. More precisely, an electrifying bias-development bias characteristic is identified in advance, and three combinations of an electrifying bias and a development bias which satisfy the identified characteristic are registered in a ROM. Following this, for density adjustment, three reference patch images are formed using the different registered bias. Thus, the conventional apparatus executed the density adjustment without considering a result of immediately preceding density adjustment at all. Densities of the respective patch images formed in this manner are measured, and an optimal electrifying bias and an optimal development bias are determined based on the measured image densities.

Hence, there is a room in the conventional technique for improving an accuracy of calculation of an optimal electrifying bias and an optimal development bias, with respect to adjustment of an image density of a toner image to a target density by means of control of an electrifying bias and a development bias.

SUMMARY OF THE INVENTION

The present invention aims at providing an image forming apparatus and an image forming method which more accurately calculate an optimal electrifying bias and an optimal development bias which are necessary for adjusting of an image density of a toner image to a target density and accordingly stabilize the image density.

In fulfillment of the foregoing object, an image forming apparatus and method are provided and are particularly well suited to density adjustment of a toner image based on image densities of a plurality of patch images. Control means adjusts an image density of the toner image to a target density by controlling an electrifying bias and a development bias. Every time adjustment is finished, the control means causes memory means to store the electrifying bias and the development bias which are obtained after the adjustment as an optimal electrifying bias and an optimal development bias, respectively. When adjustment is performed repeatedly, based on the optimal electrifying bias and the optimal development bias stored in the memory means, the control means controls such that a plurality of patch images are formed in sequence while changing at least one of the electrifying bias and the development bias.

An image forming apparatus and method according to the present invention will be described in derail by means of the following most suitable embodiments thereof.

DETAILED DESCRIPTION OF THE PREFERRED EMBODIMENTS

A. Overall Structure of Image Forming Apparatus

Figure 1:
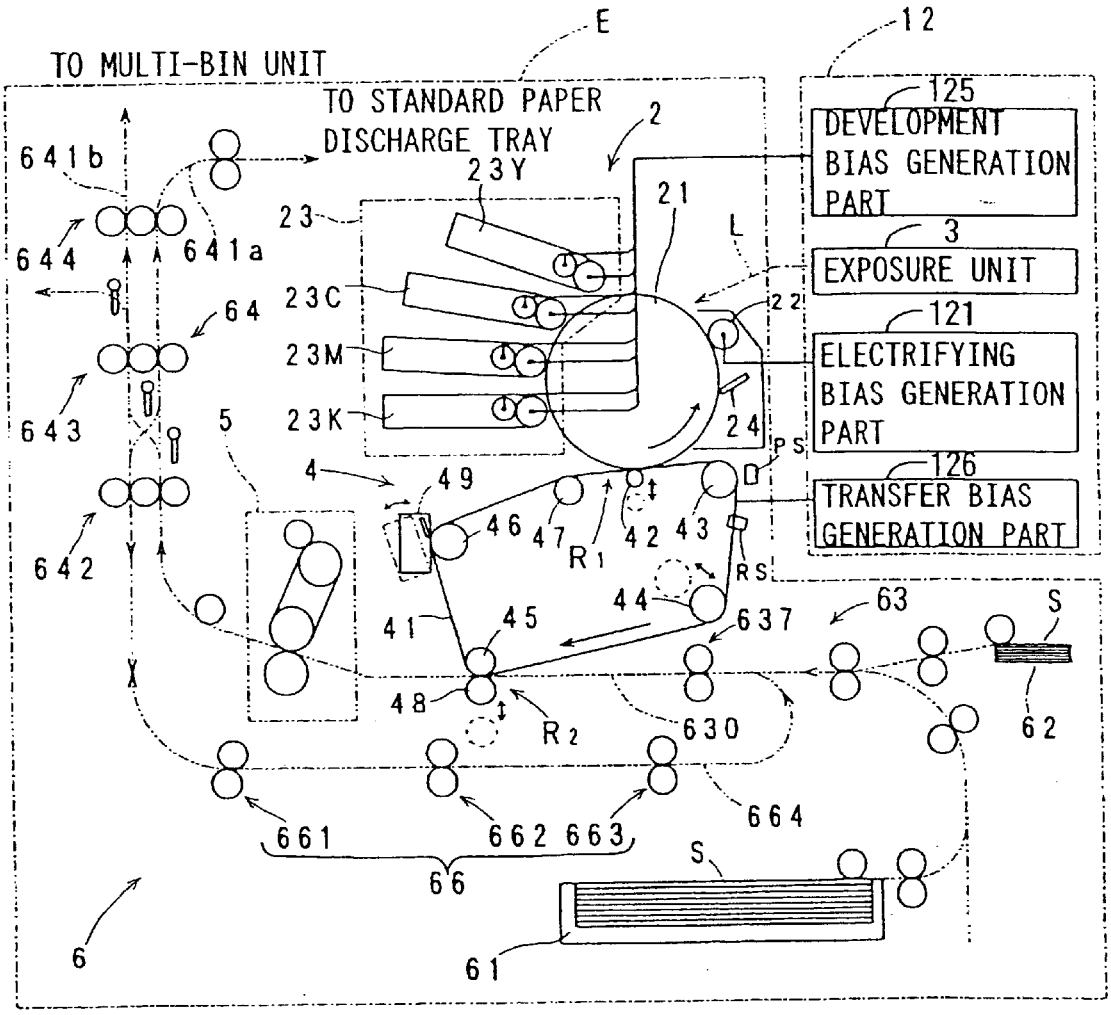
FIG. 1 is a drawing showing a preferred embodiment of an image forming apparatus according to the present invention.
Figure 2:
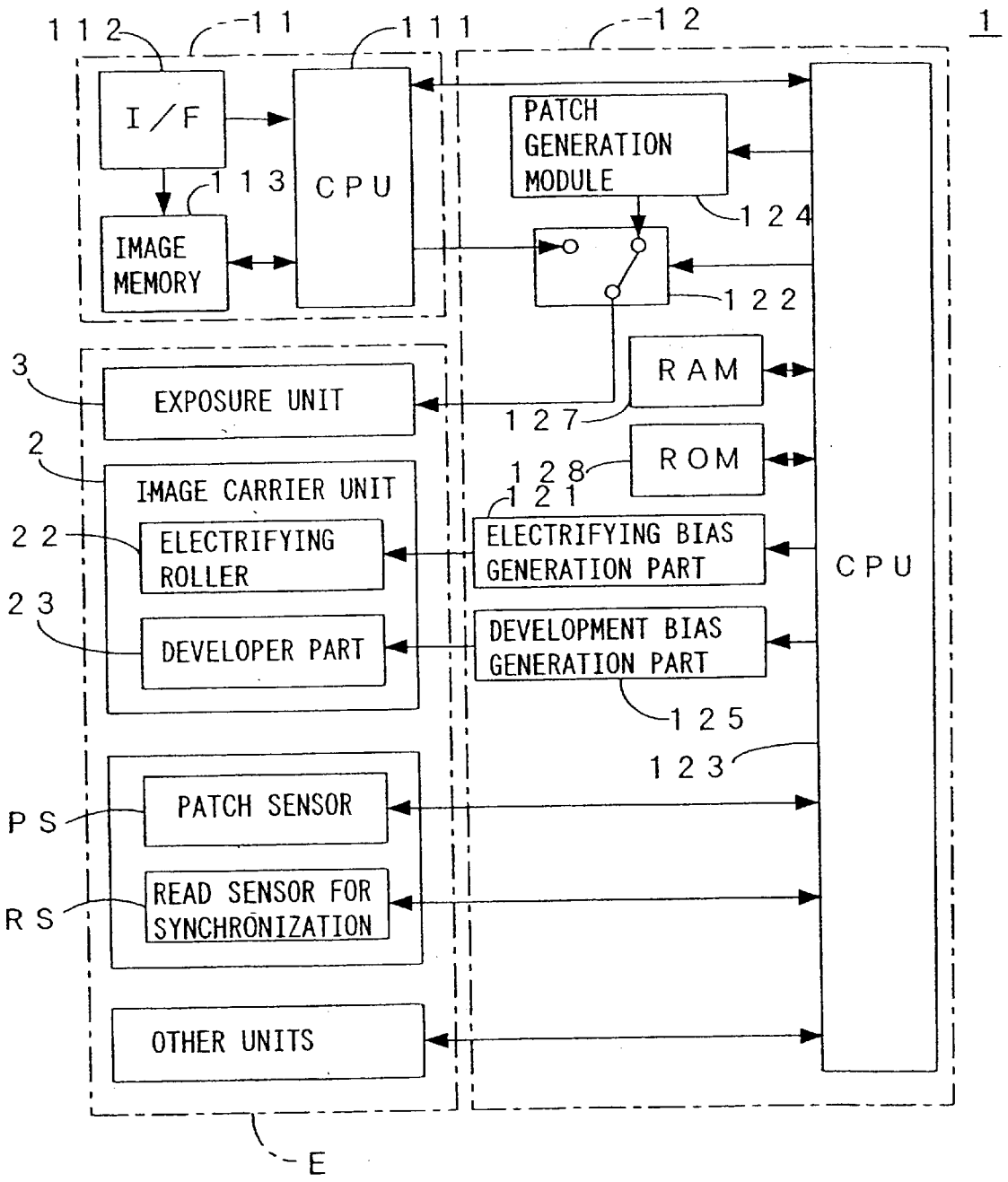
FIG. 2 is a block diagram showing an electric structure of the image forming apparatus of FIG. 1.

FIG. 1 is a drawing showing a preferred embodiment of an image forming apparatus according to the present invention. FIG. 2 is a block diagram showing an electric structure of the image forming apparatus of FIG. 1. The image forming apparatus is an apparatus which overlaps toner images in four colors of yellow (Y), cyan (C), magenta (M) and black (K) to thereby form a full-color image or uses only a black (K) toner to thereby form a monochrome image. When an image signal is supplied to a main controller 11 of a control unit 1 from an external apparatus such as a host computer, an engine controller 12 controls respective portions of an engine part E in accordance with an instruction from the main controller 11, whereby the image forming apparatus forms an image which corresponds to the image signal on a sheet S.

The engine part E is capable of forming a toner image on a photosensitive member 21 of an image carrier unit 2. That is, the image carrier unit 2 comprises the photosensitive member 21 which is rotatable in the direction of an arrow in FIG. 1. Disposed around the photosensitive member 21 and in the rotation direction of the photosensitive member 21 in FIG. 1 are an electrifying roller 22 which serves as electrifying means, developers 23Y, 23C, 23M and 23K which serve as developing means, and a cleaning part 24. Applied with a high voltage from an electrifying bias generation part 121 and in contact with an outer peripheral surface of the photosensitive member 21, the electrifying roller 22 uniformly electrifies the outer peripheral surface of the photosensitive member 21.

An exposure unit 3 irradiates laser light L toward the outer peripheral surface of the photosensitive member 21 which is electrified by the electrifying roller 22. The exposure unit 3, as shown in FIG. 2, is electrically connected with an image signal switching part 122. In accordance with an image signal which is supplied through the image signal switching part 122, the laser light L scans over the photosensitive member 21 and consequently exposes the photosensitive member 21, whereby an electrostatic latent image corresponding to the image signal is formed on the photosensitive member 21. For example, when the image signal switching part 122 is in conduction with a patch generation module 124, based on an instruction from a CPU 123 of the engine controller 12, a patch image signal outputted from the patch generation module 124 is fed to the exposure unit 3 so that a patch latent image is formed. On the other hand, when the image signal switching part 122 is in conduction with a CPU 111 of the main controller 11, the laser light L scans over and consequently exposes the photosensitive member 21 in accordance with an image signal which is supplied through an interface 112 from an external apparatus such as a host computer, so that an electrostatic latent image corresponding to the image signal is formed on the photosensitive member 21.

The electrostatic latent image which is formed in this manner is developed by a developer part 23. In other words, according to the preferred embodiment, disposed as the developer part 23 are the developer 23Y for yellow, the developer 23C for cyan, the developer 23M for magenta and the developer 23K for black which are arranged in this order around the photosensitive member 21. The developers 23Y, 23C, 23M and 23K are each structured so as to freely separate from and come close to the photosensitive member 21. In accordance with an instruction given from the engine controller 12, one of the four developers 23Y, 23C, 23M and 23K selectively contacts the photosensitive member 21. A development bias generation part 125 thereafter applies a high voltage to the photosensitive member 21, and the toner in the selected color moves to the surface of the photosensitive member 21, thereby visualizing the electrostatic latent image on the photosensitive member 21. The voltages supplied to the respective developers may be simply D.C. voltages, or alternatively, A.C. voltages superimposed over D.C. voltages.

The toner image developed by the developer part 23 is primarily transferred onto an intermediate transfer belt 41 of a transfer unit 4 in a primary transfer region R1 which is located between the black developer 23K and the cleaning part 24. A structure of the transfer unit 4 will be described in detail later.

The cleaning part 24 is disposed at a position further ahead in a circumferential direction (the direction of the arrow in FIG. 1) from the primary transfer region R1, such that a toner remaining on the outer peripheral surface of the photosensitive member 21 after the primary transfer treatment is scraped off.

Next, the structure of the transfer unit 4 will be described. According to the preferred embodiment, the transfer unit 4 comprises rollers 42 through 47, the intermediate transfer belt 41 which is spun around the rollers 42 through 47, and a secondary transfer roller 48 which secondarily transfers an intermediate toner image transferred to the intermediate transfer belt 41 onto a sheet S. A transfer bias generation part 126 applies a primary transfer voltage upon the intermediate transfer belt 41. Toner images in the respective colors formed on the photosensitive member 21 are laid one atop the other on the intermediate transfer belt 41 into a color image, while the sheet S is taken out from a cassette 61, a hand-feeding tray 62 or an additional cassette (not shown) by a paper feed part 63 of a paper feed/discharge unit 6 and conveyed to a secondary transfer region R2. The color image is thereafter secondarily transferred onto the sheet S, thereby obtaining a full-color image. Meanwhile, when a monochrome image is to be transferred onto a sheet S, only a black toner image on the photosensitive member 21 is formed on the intermediate transfer belt 41, and transferred onto a sheet conveyed to the secondary transfer region R2 to thereby obtain a monochrome image, as in the case of forming a color image.

After secondary transfer treatment, a toner remaining on and sticking to an outer peripheral surface of the intermediate transfer belt 41 is removed by a belt cleaner 49. The belt cleaner 49 is disposed opposite to the roller 46 across the intermediate transfer belt 41, and a cleaner blade contacts the intermediate transfer belt 41 at appropriate timing and scrapes off a toner from the outer peripheral surface of the intermediate transfer belt 41.

Further, disposed in the vicinity of the roller 43 is a patch sensor PS which detects a density of a patch image which is formed on the outer peripheral surface of the intermediate transfer belt 41 as described later, and so is a read sensor for synchronization RS which detects a reference position of the intermediate transfer belt 41.

Referring to FIG. 1 again, the description on the structure of the engine part E will be continued. The sheet S now seating the toner image transferred by the transfer unit 4 is conveyed by the paper feed part 63 of the paper feed/discharge unit 6 to a fixing unit 5 which is disposed on the downstream side to the secondary transfer region R2 along a predetermined paper feed path (dot-dot-dash line), and the toner image on the conveyed sheet S is fixed on the sheet S. The sheet S is thereafter conveyed to a paper discharge part 64 along the paper feed path 630.

The paper discharge part 64 has two paper discharge paths 641*a* and 641*b*. The paper discharge path 641*a* extends from the fixing unit 5 to a standard paper discharge tray, while the paper discharge path 641*b* extends approximately parallel to the paper discharge path 641*a* between a paper re-feed part 66 and a multi-bin unit. Three roller pairs 642 through 644 are disposed along the paper discharge paths 641*a* and 641*b*, so as to discharge the sheets S toward the standard paper discharge tray or the multi-bin unit and convey the sheets S toward the paper re-feed part 66 for the purpose of forming images on non-printing surfaces of the sheets S.

Aiming at conveying a sheet S which was inverted and fed from the paper discharge part 64 as described above to a gate roller pair 637 of the paper feed part 63 along a paper re-feed path 664 (dot-dot-dash line), the paper re-feed part 66 is formed of three paper re-feed roller pairs 661 through 663 which are disposed along the paper re-feed path 664 as shown in FIG. 1. In this manner, the sheet S sent from the paper discharge part 64 is returned to the gate roller pair 637 along the paper re-feed path 664 and a non-printing surface of the sheet S is directed toward the intermediate transfer belt 41 within the paper feed part 63, which makes it possible to secondarily transfer the image onto the non-printing surface.

In FIG. 2, denoted at 113 is an image memory which is disposed in the main controller 11 such that the image memory stores image data supplied from an external apparatus such as a host computer through the interface 112, denoted at 127 is a RAM which temporarily stores control data for controlling the engine part E, a calculation result obtained by the CPU 123, etc., and denoted at 128 is a ROM which stores a calculation program which is executed by the CPU 123.

B. Density Adjustment by Image Forming Apparatus

Now, a description will be given on how the image forming apparatus having such a structure as described above adjusts a density of an image.

Figure 3:
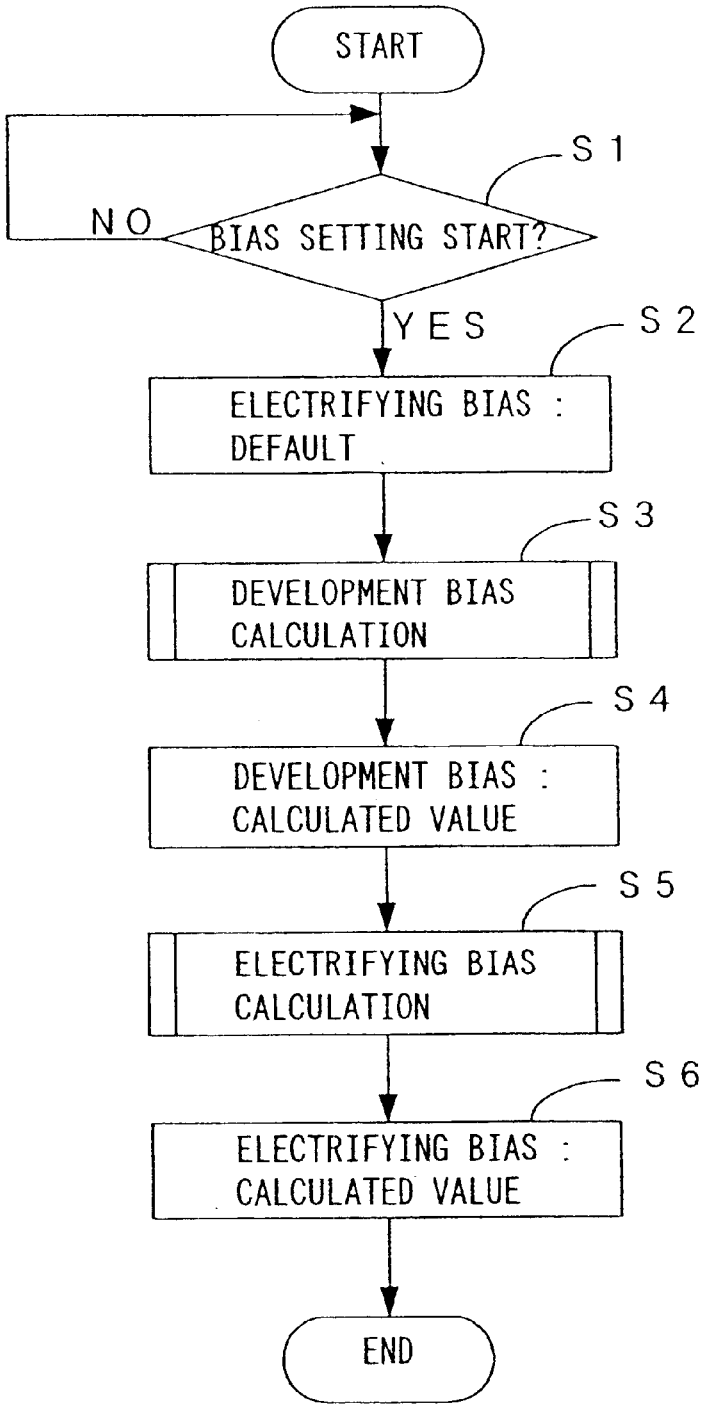
FIG. 3 is a flow chart showing a density adjustment operation in the image forming apparatus of FIG. 1.

FIG. 3 is a flow chart showing a density adjustment operation in the image forming apparatus of FIG. 1. In the image forming apparatus, as shown in FIG. 3, it is determined at a step S1 whether the density adjustment operation should be executed to thereby update an electrifying bias and a development bias. For example, the image forming apparatus may start setting the biases when the image forming apparatus becomes ready to form an image after a main power source of the image forming apparatus is turned on. Alternatively, the image forming apparatus may set the biases every few hours while a timer (not shown) disposed in the image forming apparatus measures hours of continuous use.

When it is determined YES at the step S1 and setting of the biases is accordingly started, steps S2 and S3 are executed to calculate an optimal development bias, and the calculated bias is set as the development bias (step S4). Following this, a step S5 is executed to calculate an optimal electrifying bias, and the calculated bias is set as the electrifying bias (step S6). The electrifying bias and the development bias are optimized in this manner. In the following, a detailed description will be given on an operation of each one of the development bias calculation (step S3) and the electrifying bias calculation (step S5).

B-1. Development Bias Calculation

Figure 4:
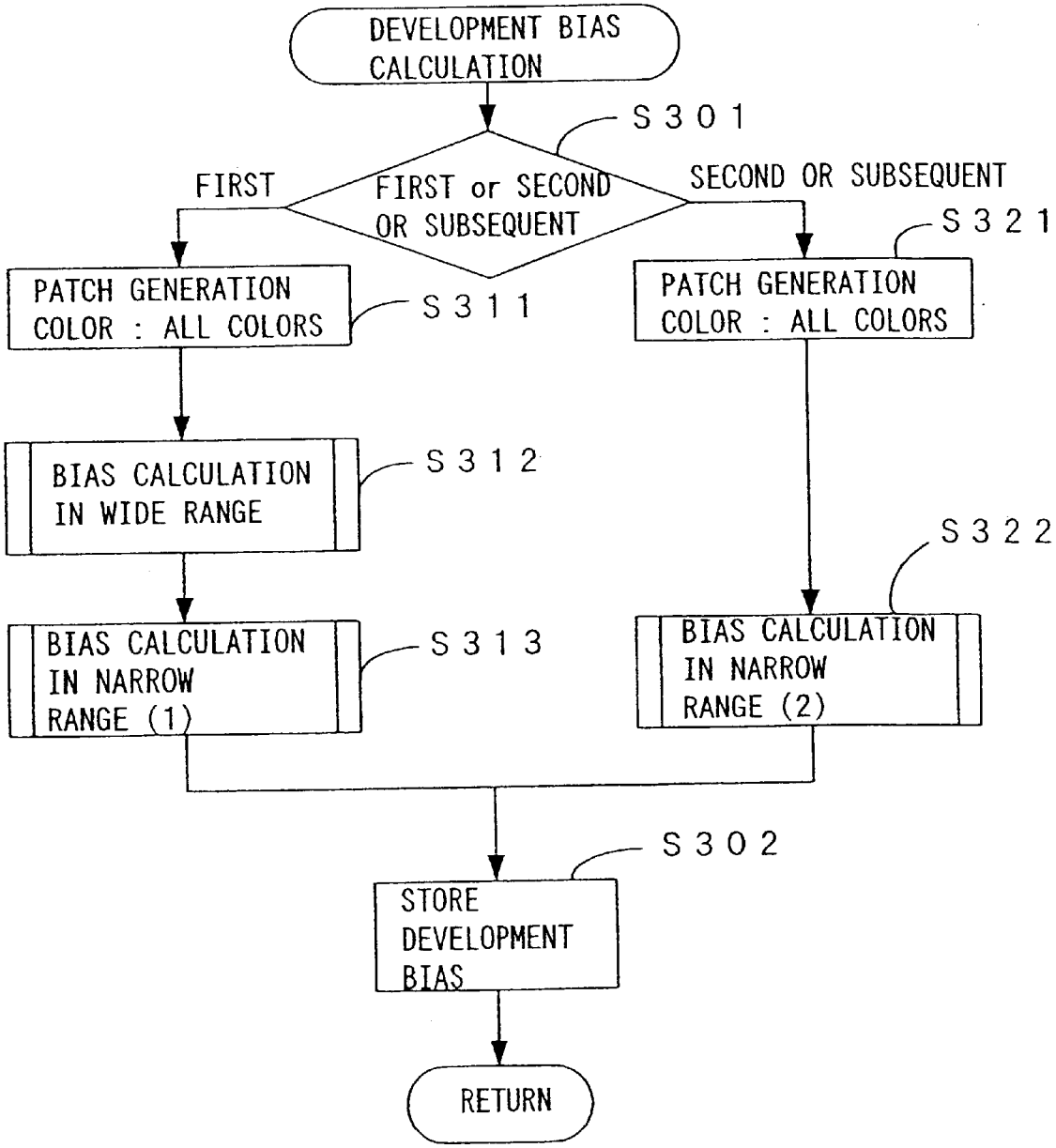
FIG. 4 is a flow chart showing an operation of development bias calculation of FIG. 3.

FIG. 4 is a flow chart showing an operation of the development bias calculation shown in FIG. 3. In the development bias calculation (step S3), the CPU 123 determines whether this is first calculation or the second or subsequent calculation after the main power source of the image forming apparatus is turned on (step S301). When the current calculation is the first one, after setting up such that patch images will be created in all colors (which are the four colors of yellow (Y), cyan (C), magenta (M) and black (K) in this preferred embodiment) (step S311), an immediately subsequent step S312 is executed. In other words, a plurality of patch images are formed while gradually changing the development bias at relatively long intervals within a relatively wide range, thereby tentatively identifying a development bias which is necessary to obtain an optimal image density based on densities of the respective patch images. Now, an operation of this processing will be described in detail with reference to FIGS. 5 and 6A through 6D.

Figure 5:
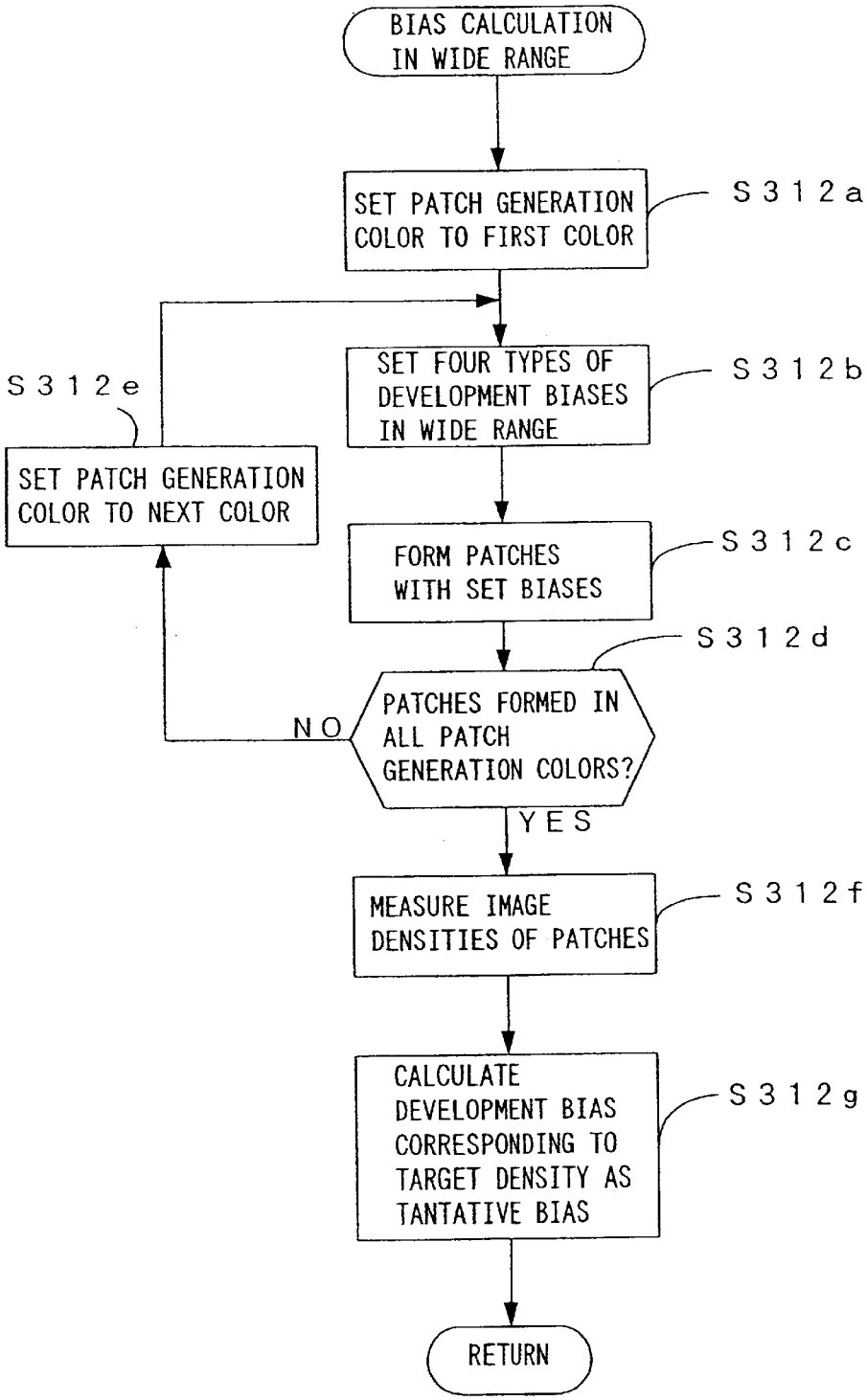
FIG. 5 is a flow chart showing an operation of the bias calculation of FIG. 4 in a wide range.

FIG. 5 is a flow chart showing an operation of the bias calculation of FIG. 4 within a wide range. FIGS. 6A through 6D are schematic diagrams showing an operation of the processing of FIG. 5 and an operation of the bias calculation within narrow range which will be described later. During this calculation, a color in which patch images are to be generated is set as the first color, e.g., yellow (step S312*a*). With the electrifying bias set to a default value which is set in advance at the step S2, the development bias is set to four different values which are apart at relatively long intervals (first intervals) within the wide range (step S312*b*). For instance, in this preferred embodiment, the wide range is the entirety of a programmable range (Vb01–Vb10) of development bias which can be supplied to the developer part 23 from the development bias generation part 125, and four points Vb01, Vb04, Vb07 and Vb10 within the wide range (Vb01–Vb10) are set as development biases. In this manner, according to this preferred embodiment, the first intervals W1 are:

$$W1=Vb10-Vb07=Vb07-Vb04=Vb04—Vb01$$

Figure 7:
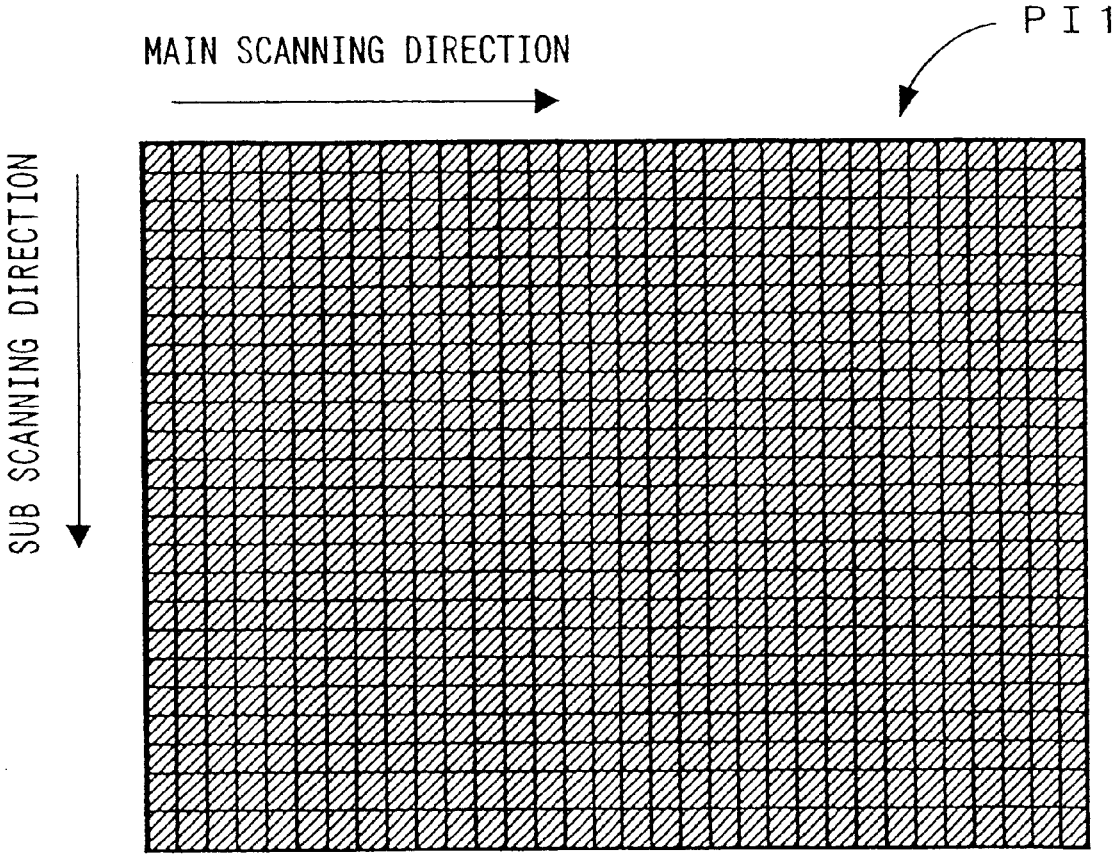
FIG. 7 is a drawing showing a first patch image.
Figure 8A:
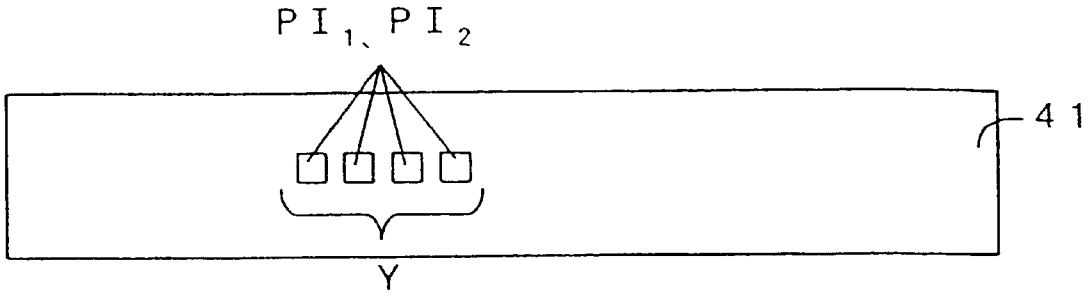
FIGS. 8A through 8D are drawings showing an order of forming patch images.

Four yellow solid images (FIG. 7) are sequentially formed on the photosensitive member 21 with this bias setup, and the solid images are transferred onto the outer peripheral surface of the intermediate transfer belt 41 as shown in FIG. 8A to thereby form first patch images PI1 (step S312*c*). The first patch images PI1 are solid images in this preferred embodiment. The reason of this will be described in detail later.

Figure 8B:
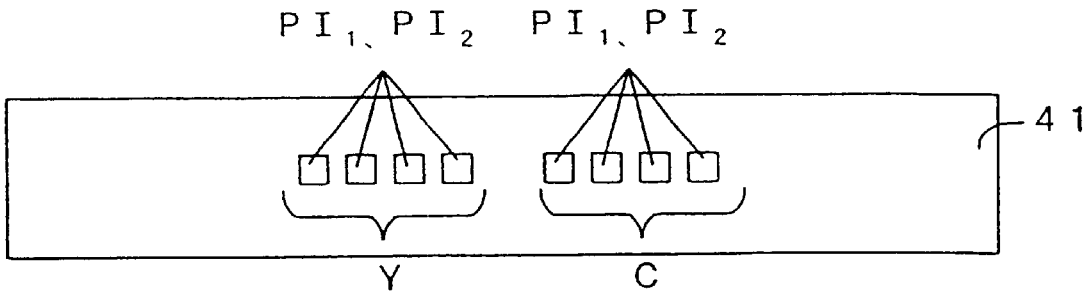
Figure 8C:
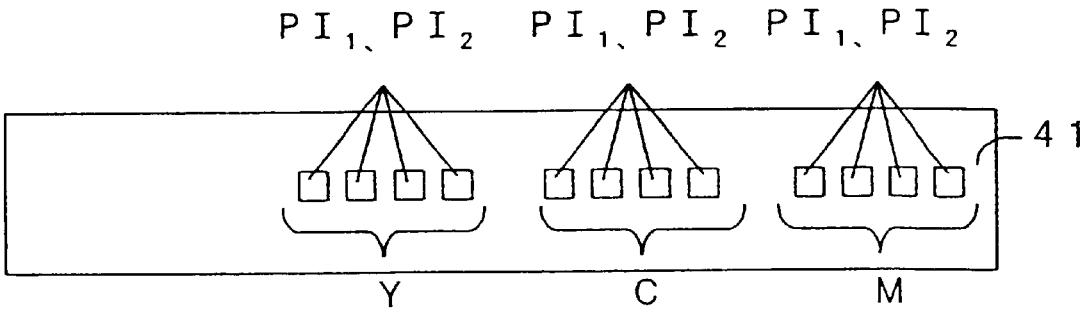
Figure 8D:
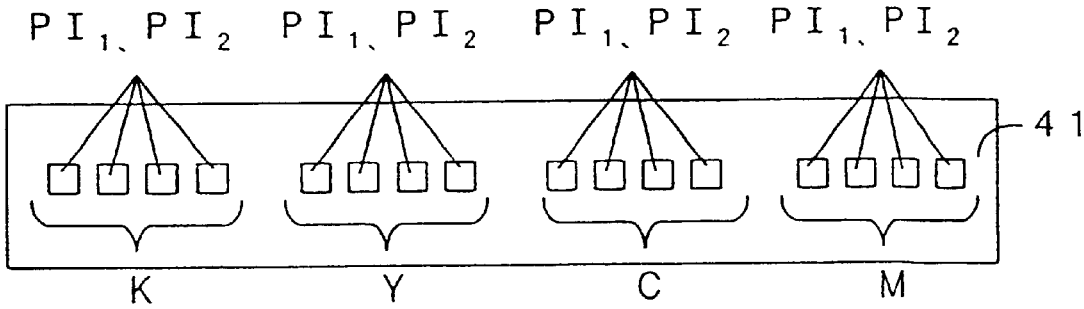

At a subsequent step S312*d*, whether patch images are formed in all of patch generation colors is determined. While a result of the judgement stays NO, the next color is set as a patch generation color (step S312*e*) and the steps S312*b* and S312*c* are repeated. This adds further first patch images PI1 on the outer peripheral surface of the intermediate transfer belt 41, in the order of cyan (C), magenta (M) and black (K), as shown in FIGS. 8B through 8D.

On the contrary, when it is determined YES at the step S312*d*, image densities of the sixteen (=4 types×4 colors) patch images PI1 are measured on the basis of a signal outputted from the patch sensor PS (step S312*f*). While the image densities of the patch images PI1 are measured at once after forming the patch images PI1 in all patch generation colors in this preferred embodiment, the image densities of the patch images PI1 may be measured sequentially color by color every time the patch images PI1 in one patch generation color are formed. This applies to the later bias calculation (FIGS. 9, 10 and 12) as well.

Figure 6A:
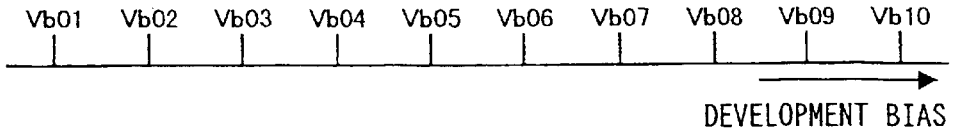
FIGS. 6A through 6D are schematic diagrams showing an operation of the processing of FIG. 5 and an operation of the bias calculation in a narrow range.
Figure 6B:
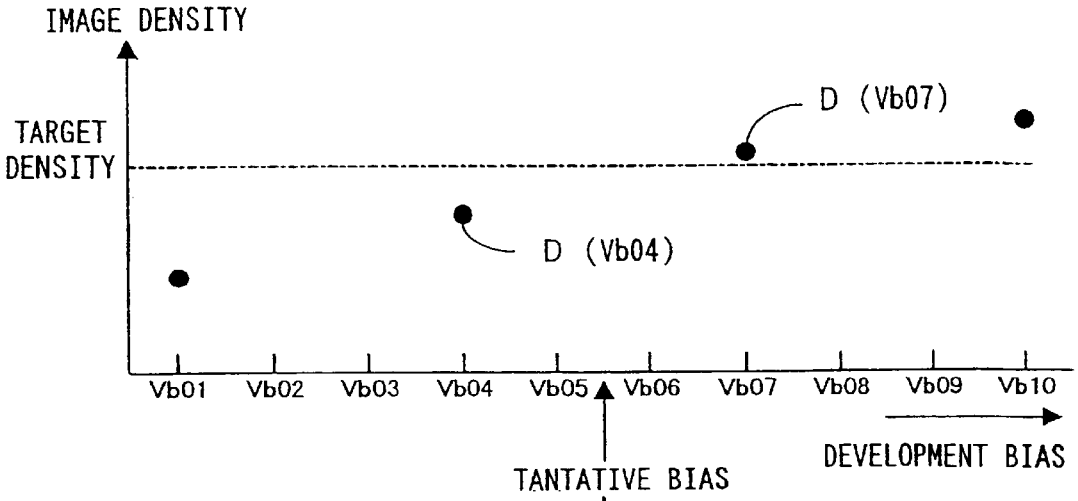

Following this, a development bias corresponding to a target density is calculated at a step S312*g*, and the calculated bias is stored temporarily in the RAM 127 as an interim bias. When a measurement result (image density) matches with the target density, a development bias corresponding to this image density may be used as the interim bias. When the two density values fail to match, as shown in FIG. 6B, it is possible to calculate an interim bias through linear interpolation, averaging or other appropriate methodology in accordance with data D (Vb04) and data D (Vb07) which are on the both sides of the target density.

Figure 6C:
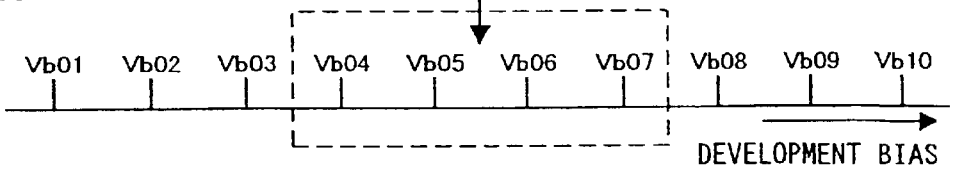
Figure 9:
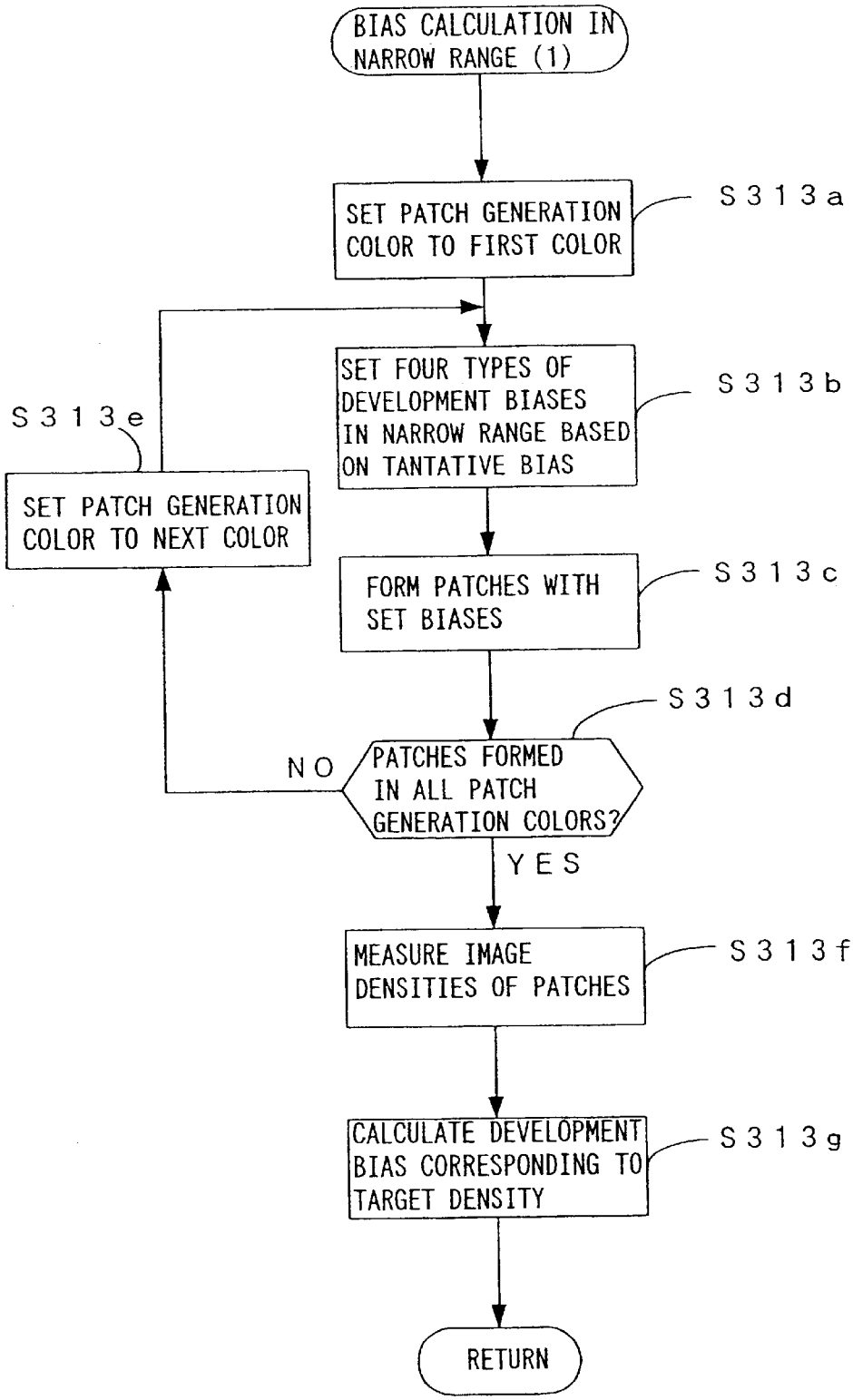
FIG. 9 is a flow chart showing an operation of bias calculation (1) of FIG. 4 in the narrow range.

Once the interim bias is determined in this manner, the bias calculation (1) in the narrow range shown in FIG. 4 is executed. FIG. 9 is a flow chart showing an operation of the bias calculation (1) of FIG. 4 in the narrow range. During this calculation, a color in which patch images are to be generated is set as the first color, e.g., yellow (step S313*a*), as in the earlier calculation (step S312). With the electrifying bias set to the default value which is set in advance at the step S2, the development bias is set to four different values which are apart at narrower intervals (second intervals) than the first intervals W1 within a narrow range which includes the interim bias (step S313*b*). For instance, in this preferred embodiment, the narrow range is approximately ⅓ of the programmable range (Vb01–Vb10) of development bias. When the interim bias is between development biases Vb05 and Vb06 as shown in FIG. 6B, four points Vb04, Vb05, Vb06 and Vb07 are set as development biases (FIG. 6C). In this manner, according to this preferred embodiment, the second intervals W2 are:

$$W2=Vb07-Vb06=Vb06-Vb0S=Vb05-Vb04$$

Four yellow solid images (FIG. 7) are sequentially formed on the photosensitive member 21 with this bias setup, and the solid images are transferred onto the outer peripheral surface of the intermediate transfer belt 41 as shown in FIG. 8A to thereby form first patch images PI1 (step S313*c*). As in the earlier calculation (step S312), the next color is set as a patch generation color (step S313*e*) and the steps S313*b* and S313*c* are repeated until it is determined at a step S313*d* that patch images are formed in all of patch generation colors. As a result, first patch images PI1 are further formed on the outer peripheral surface of the intermediate transfer belt 41, in the order of cyan (C), magenta (M) and black (K).

Figure 6D:
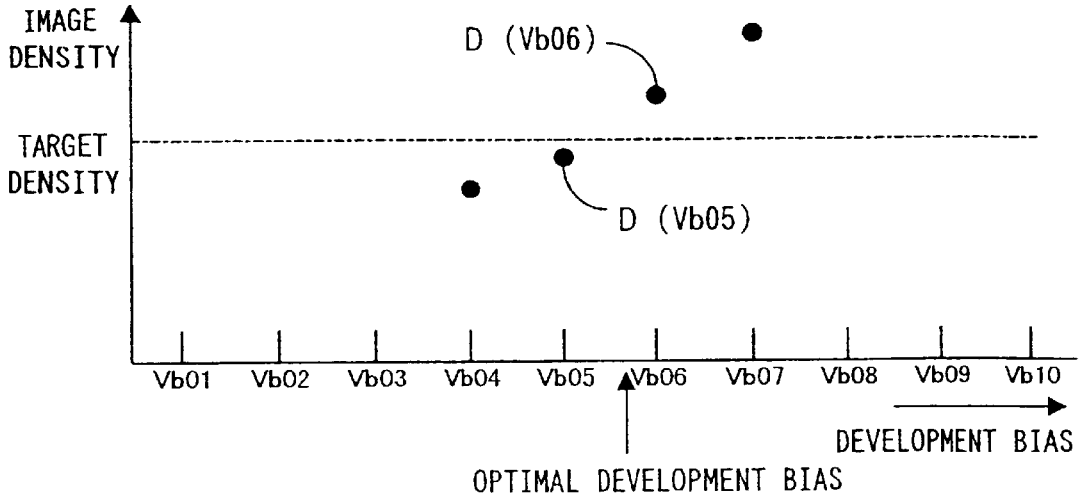

Once sixteen (=4 types×4 colors) patch images PI1 are formed on the intermediate transfer belt 41 in this manner, image densities of the respective patch images PI1 are measured on the basis of a signal outputted from the patch sensor PS (step S313*f*). Following this, at a step S313*g*, a development bias corresponding to a target density is calculated. When a measurement result (image density) matches with the target density, a development bias corresponding to this image density may be used as an optimal development bias. When the two density values fail to match, as shown in FIG. 6D, it is possible to calculate an optimal development bias through linear interpolation, averaging or other appropriate methodology in accordance with data D (Vb05) and data D (Vb06) which are on the both sides of the target density.

The RAM 127 stores the optimal development bias which is calculated in this manner (step S302 in FIG. 4), and reads it out as the development bias during calculation of the electrifying bias which will be described later or while an image is formed in a normal manner.

By the way, as described earlier in Description of the Related Art, while an optimal electrifying bias and an optimal development bias change due to fatigue, degradation with age or the like of a photosensitive member, a toner, etc., the changes possess a continuity to a certain extent. Hence, where an image density is repeatedly adjusted, it is possible to predict an optimal development bias based on an image density which is measured immediately previously (e.g., the step S313*f*, and steps S322*f* and S510 which will described later). Noting this, in the bias calculation (step S3) according to this preferred embodiment, when the current calculation is determined to be the second or subsequent calculation after the main power source of the image forming apparatus is turned on, that is, when it is determined at the step S301 in FIG. 4 to follow the SECOND OR SUBSEQUENT path, after setting up such that patch images will be created in all colors (which are the four colors of yellow (Y), cyan (C), magenta (M) and black (K) in this preferred embodiment) (step S321), an immediately subsequent step S322 is executed. In other words, bias calculation (2) within the narrow range is executed to thereby calculate an optimal development bias using biases which are measured immediately previously and stored in the RAM 127 as a reference. Now, an operation of this processing will be described in detail with reference to FIG. 10.

Figure 10:
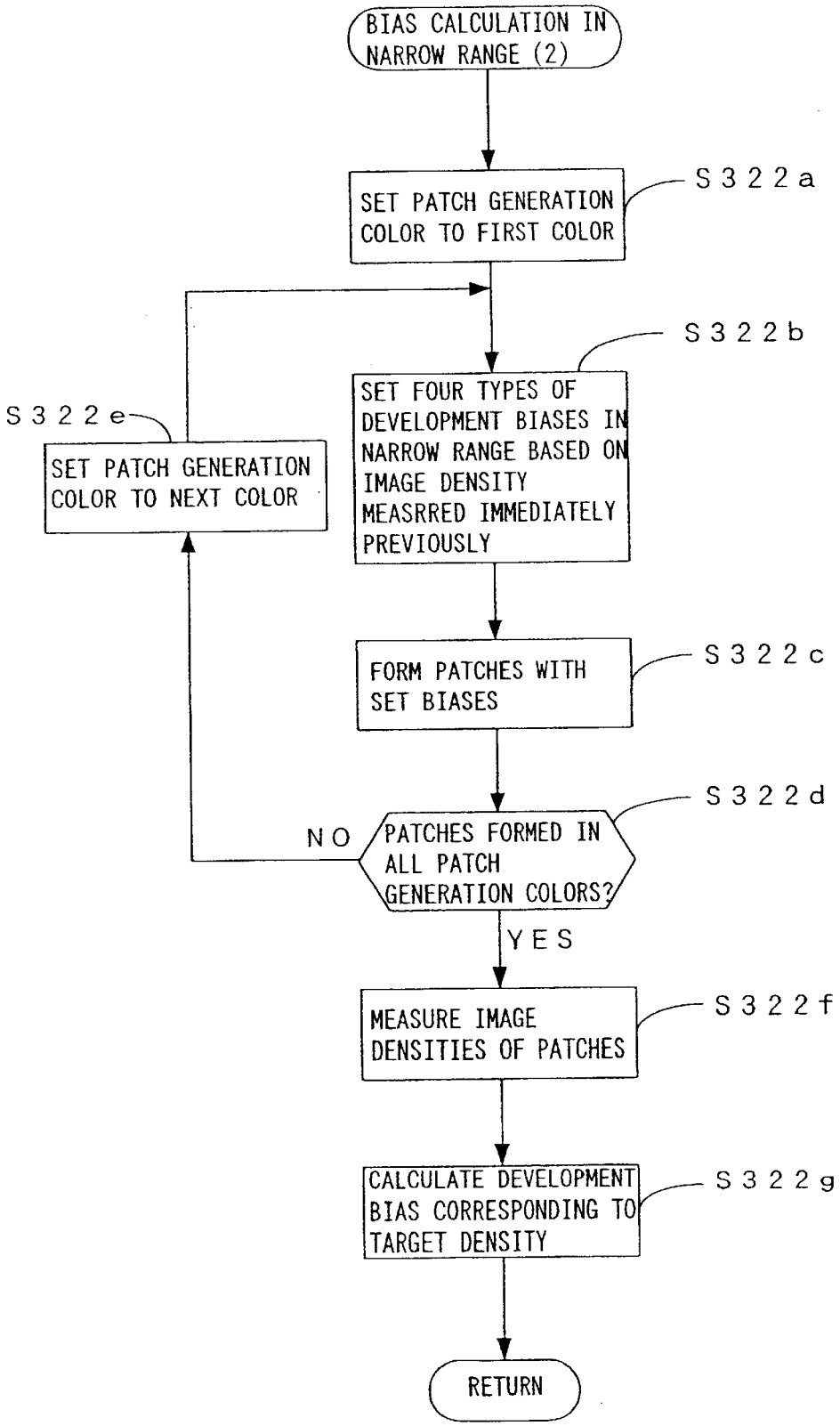
FIG. 10 is a flow chart showing an operation of bias calculation (2) of FIG. 4 in the narrow range.
Figure 11A:
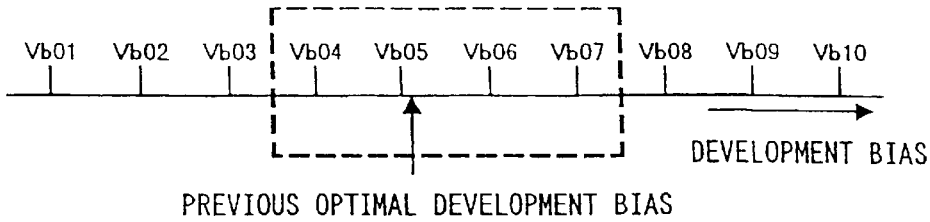
FIGS. 11A and 11B are schematic diagrams showing the operation of the processing of FIG. 10.
Figure 11B:
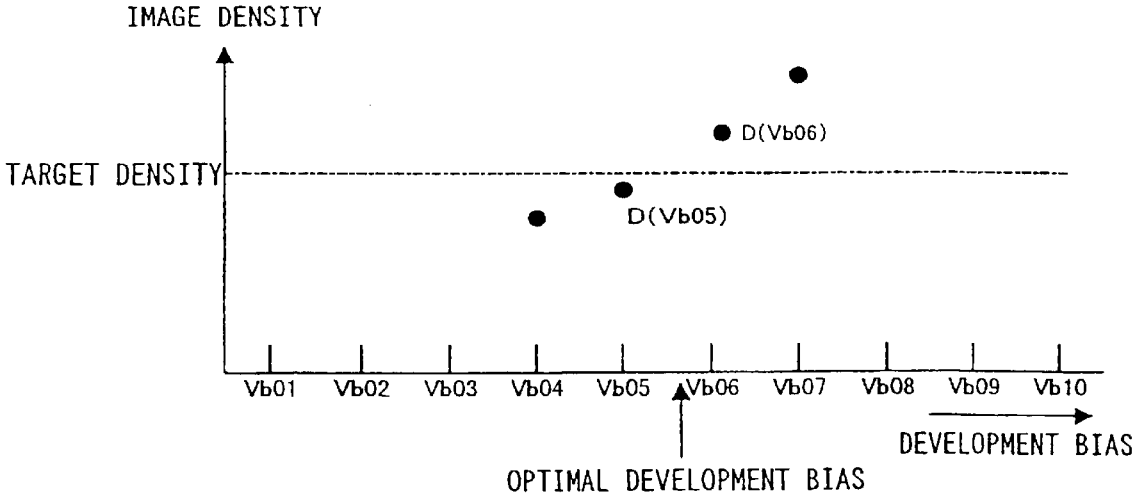

FIG. 10 is a flow chart showing an operation of the bias calculation (2) of FIG. 4 within the narrow range. FIGS. 11A and 11B are schematic diagrams showing the operation of the processing shown in FIG. 10. This calculation processing is largely different from the bias calculation (1) within the narrow range described earlier in regard to the following. During the calculation (1) shown in FIG. 9, the electrifying bias set to the default value, and four different types of development biases are set based on an interim bias (step S313*b*). Meanwhile, during the bias calculation (2), the electrifying bias is the optimal electrifying bias which is calculated through immediately preceding measurement and stored in the RAM 127, and four different types of development biases are set within the narrow range based on the optimal development bias which is stored in the RAM 127 (step S322*b*). The bias calculation (2) is structured otherwise the same as the bias calculation (1), and therefore, a redundant description will be simply omitted.

In this manner, during the second or subsequent density adjustment, the four different types of development biases are set. The four biases are apart at the second intervals within the narrow range using the development bias which is calculated immediately previously (preceding optimal development bias) without calculating an interim bias, the patch images are formed in the respective colors, and the optimal development bias is calculated. Hence, as compared to the first density adjustment (step S312+step S313), it is possible to calculate an optimal development bias in a further shorter time.

In addition, as compared with the conventional technique, the present invention realizes a unique effect that it is possible to calculate an optimal development bias at a high accuracy. The reason of this will now be described. According to the conventional technique, three pairs of an electrifying bias and a development bias are stored in advance, and patch images are formed using the three development biases, respectively. Hence, in order to cover a range of possible changes in the development biases, namely, a range which is approximately the same as the programmable range of development bias, it is necessary to set the three development biases at relatively long intervals.

In contrast, according to this preferred embodiment, the development bias is changed within the narrow range including the immediately preceding optimal development bias out of the programmable range (Vb01–Vb10) of development bias. That is, this preferred embodiment requires only approximately ⅓ of the programmable range of development bias, and the intervals of the development biases according to this preferred embodiment (second intervals) are narrower than those used in the conventional technique. Due to this, the present invention allows to calculate an optimal development bias at a better accuracy. It is to be noted that a simple reduction of the range in which a development bias is to be changed causes an optimal development bias to be calculated to deviate from the reduced range and only makes it difficult to accurately calculate an optimal development bias. However, according to this preferred embodiment, since the narrow range is set around an immediately preceding optimal development bias, it is extremely unlikely to see such a problem.

The engine controller 12 writes the optimal development bias which is calculated in this manner over the preceding optimal development bias which is already stored in the RAM 127, thereby updating the optimal development bias (step S302 in FIG. 4). The sequence thereafter returns to FIG. 3 which requires to read the optimal development bias from the RAM 127 and set the retrieved optimal development bias as the development bias. An optimal electrifying bias is thereafter calculated (step S5) and set as the electrifying bias (step S6).

B-2. Optimal Electrifying Bias Calculation

Figure 12:
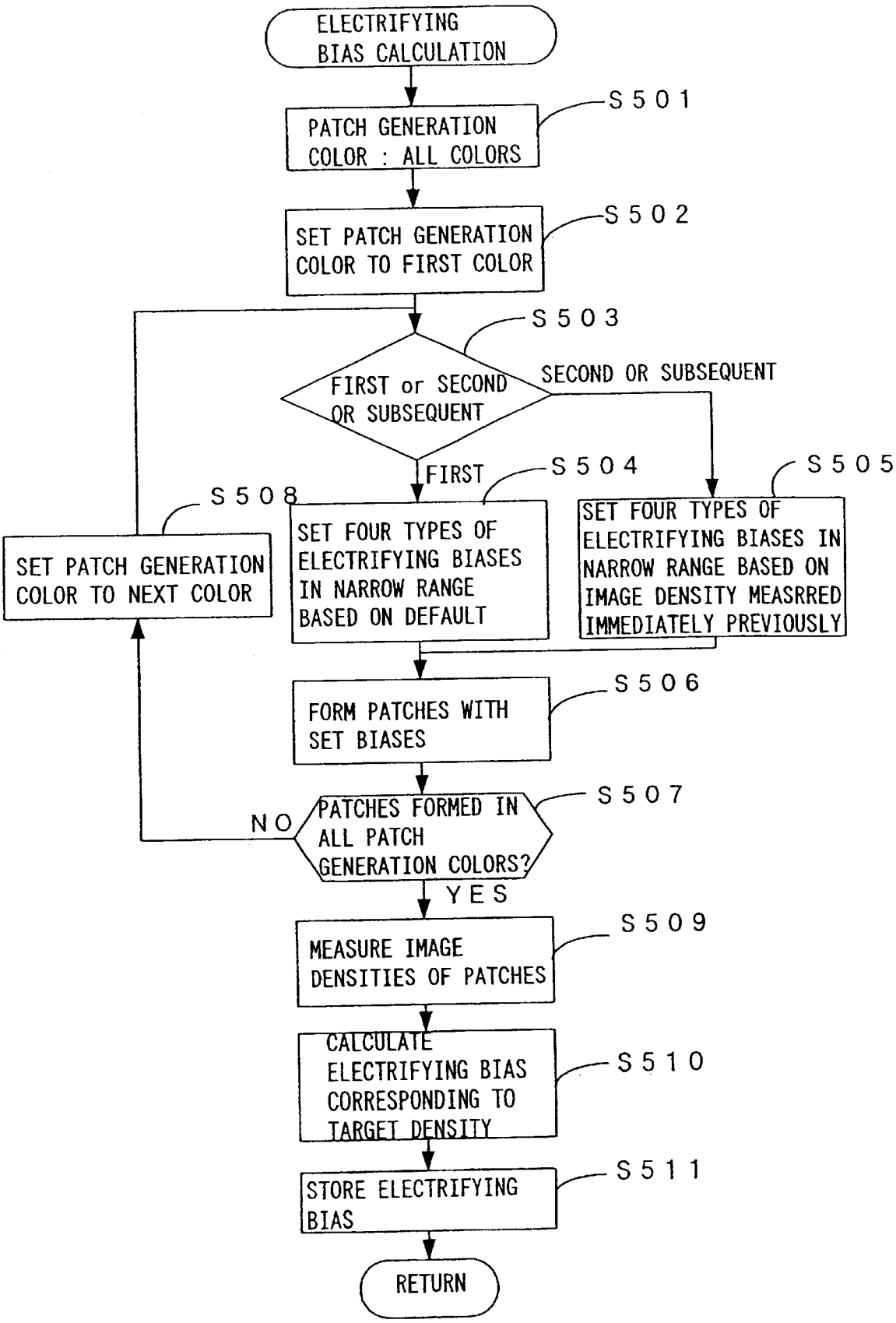
FIG. 12 is a flow chart showing an operation of the electrifying bias calculation of FIG. 3.
Figure 13A:
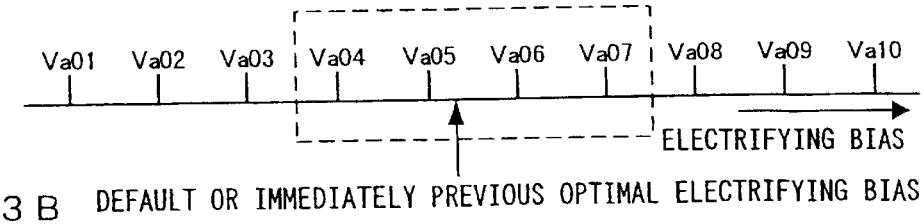
FIGS. 13A and 13B are schematic diagrams showing the operation of the processing of FIG. 12.
Figure 13B:
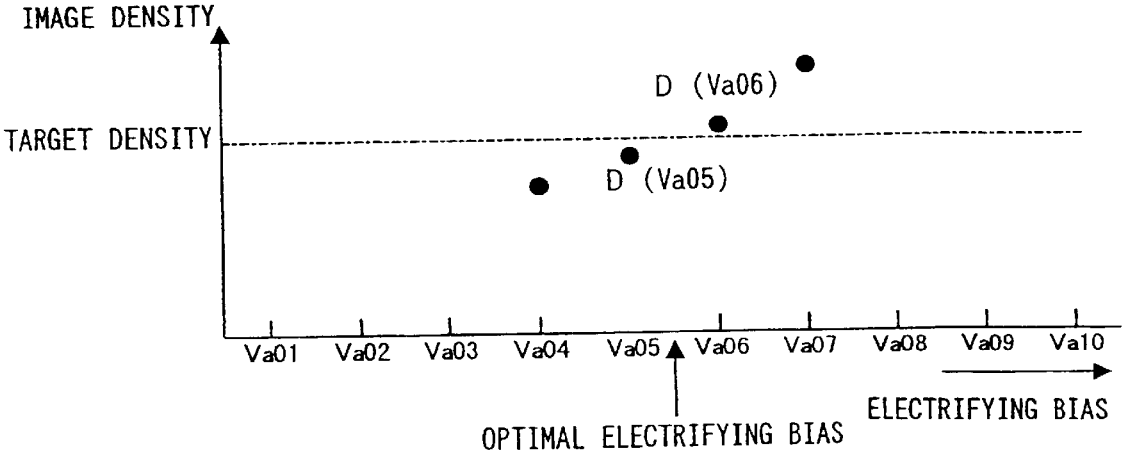

FIG. 12 is a flow chart showing an operation of the electrifying bias calculation of FIG. 3. FIGS. 13A and 13B are schematic diagrams showing the operation of the processing shown in FIG. 12. During the electrifying bias calculation (step S5), after setting up such that patch images will be created in all colors (which are the four colors of yellow (Y), cyan (C), magenta (M) and black (K) in this preferred embodiment) (step S501), a color in which second patch images are to be generated is set as the first color, e.g., yellow at a step S502.

As in the development bias calculation, the CPU 123 determines whether the current electrifying bias calculation is first such calculation or the second or subsequent calculation after the main power source of the image forming apparatus is turned on (step S503). When the current calculation is determined to be the first one, a step S504 is executed. When the current calculation is determined to be the second or subsequent calculation, a step S505 is executed.

At the step S504, the electrifying bias is set to four different values. The four biases are apart at relatively narrow intervals (third intervals) within the narrow range which includes the default value. Meanwhile, at the step S505, the electrifying bias is set to four different values which are apart at relatively narrow intervals (third intervals) within the narrow range which includes a preceding optimal electrifying bias. In this manner, unlike the development bias calculation, the electrifying bias calculation executes only narrow-range calculation without calculating within the wide range. In this preferred embodiment, the narrow range is approximately ⅓ of a programmable range (Va01–Va10) of electrifying bias. When the default value or an immediately preceding optimal electrifying bias is between electrifying biases Va05 and Vb06 as shown in FIG. 13A, four points Va04, Va05, Va06 and Va07 are set as electrifying biases. That is, according to this preferred embodiment, the third intervals W3 are:

$$W3=Va07-Va06=Va06-Va05=Va05-Va04$$

Figure 14:
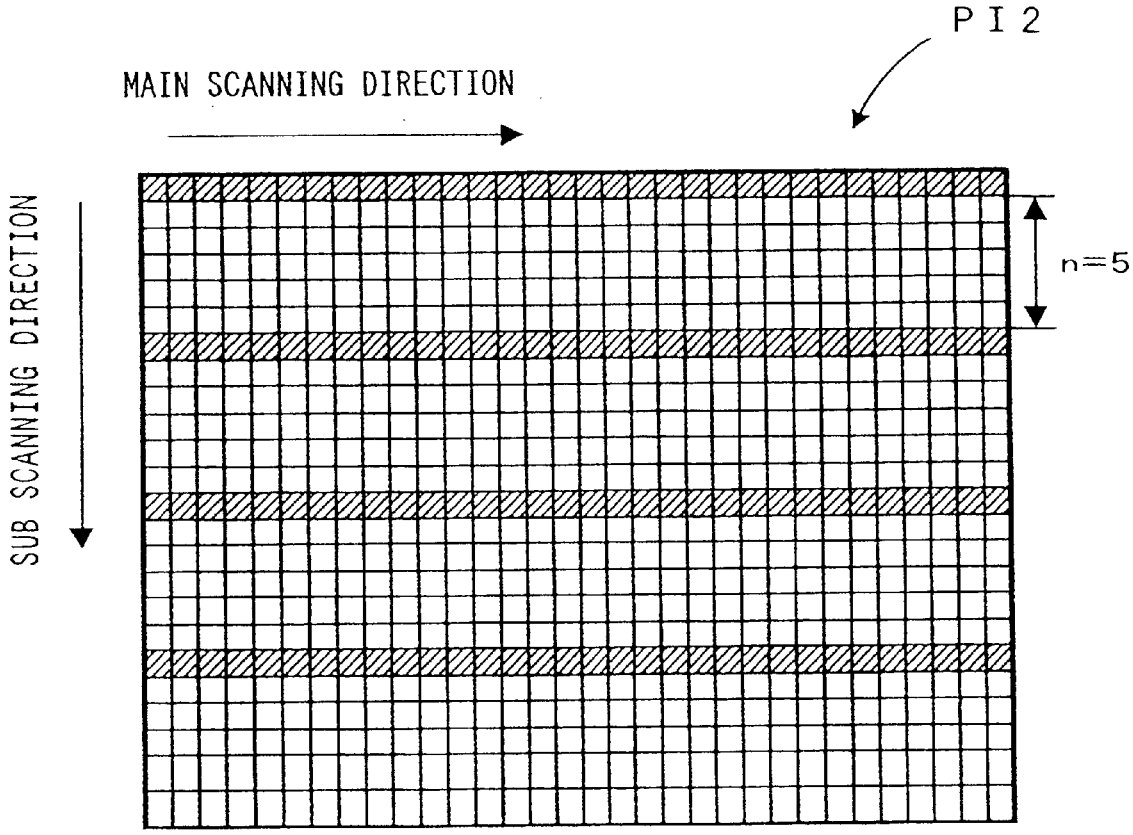
FIG. 14 is a drawing showing a second patch image.

Once four types of electrifying biases are set up for the yellow color in this manner, respective yellow halftone images (See FIG. 14) are sequentially formed on the photosensitive member 21 and transferred onto the outer peripheral surface of the intermediate transfer belt 41, whereby second patch images PT2 are formed (FIG. 8A: step S506). The second patch images PI2 are halftone images in this preferred embodiment. The reason of this will be described in detail later, together with the reason that first patch images are solid images.

At a subsequent step S507, whether the second patch images are formed in all of patch generation colors is judged. While a result of the judgement stays NO, the next color is set as a patch generation color (step S508) and the steps S503 through S507 are repeated. This adds further second patch images PI2 on the outer peripheral surface of the intermediate transfer belt 41, in the order of cyan (C), magenta (M) and black (K), as shown in FIGS. 8B through 8D.

On the contrary, when it is determined YES at the step S507, image densities of the sixteen (=4 types×4 colors) patch images PI2 are measured on the basis of a signal outputted from the patch sensor PS (step S509). Following this, an electrifying bias corresponding to a target density is calculated (step S510), and the calculated electrifying bias is stored in the RAM 127 as an optimal electrifying bias (step S511). When a measurement result (image density) matches with the target density, an electrifying bias corresponding to this image density may be used as an optimal electrifying bias. When the two density values fail to match, as shown in FIG. 13B, it is possible to calculate an optimal electrifying bias through linear interpolation, averaging or other appropriate methodology in accordance with data D (Va05) and data D (Va06) which are on the both sides of the target density.

As described above, according to this preferred embodiment, during the second or subsequent density adjustment, the four types of electrifying biases are set up in the narrow range using biases which are measured immediately previously and stored in the RAM 127, the patch images are formed in the respective colors, and the optimal electrifying bias is calculated. Hence, unlike the conventional technique, this preferred embodiment realizes a similar effect to that of the development bias calculation. In other words, according to the conventional technique, three pairs of an electrifying bias and a development bias are stored in advance, and patch images are formed using the three electrifying biases, respectively. Hence, in order to cover a range of possible changes in the electrifying bias, namely, a range which is approximately the same as the programmable range of electrifying bias, it is necessary to set the three electrifying biases at relatively long intervals.

In contrast, according to this preferred embodiment, the electrifying bias is changed within the narrow range including an immediately preceding optimal electrifying bias out of the programmable range (V01–Va10) of electrifying bias. That is, the preferred embodiment requires only approximately ⅓ of the programmable range of electrifying bias, and the intervals of the electrifying biases according to this preferred embodiment (third intervals W3) are narrower than those used in the conventional technique. Due to this, the present invention allows to calculate an optimal electrifying bias at a further higher accuracy. It is to be noted that a simple reduction of the range in which an electrifying bias is to be changed merely causes an optimal electrifying bias to be calculated to deviate from the reduced range and makes it difficult to accurately calculate an optimal electrifying bias. However, according to this preferred embodiment, since the narrow range is set around an immediately preceding optimal electrifying bias, it is extremely unlikely to see such a problem.

Once the optimal electrifying bias is determined in this manner, the optimal electrifying bias calculated as described above is read from the RAM 127 and set as the electrifying bias, in addition to the optimal development bias already set as the development bias. When an image is formed with this setup, the resultant image has the target density. In other words, the image density is stable.

By the way, solid images are used as the first patch images for the development bias calculation while halftone images are used as the second patch images for the electrifying bias calculation in this preferred embodiment for the following reason.

Figure 15A:
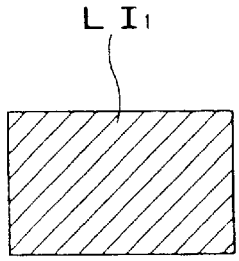
FIGS. 15A and 15B are drawings showing a relationship between the first patch images, a surface potential and a development bias potential.
Figure 15B:
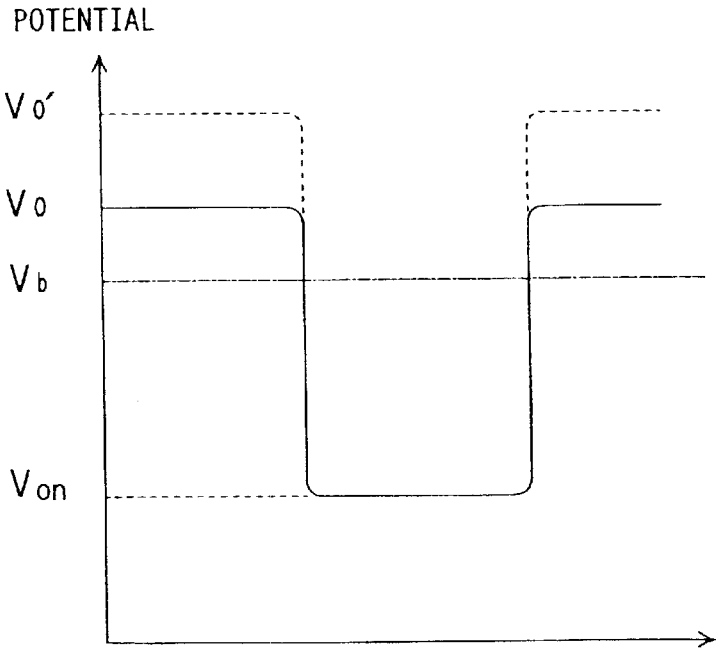

As an electrostatic latent image LI1 of a solid image (first patch image) PI1 (See FIG. 7) is formed on the surface of the photosensitive member 21 which is electrified uniformly at a surface potential V0, a surface potential corresponding to the electrostatic latent image LI1 largely drops down to a potential (exposed area potential) Von as shown in FIGS. 15A and 15B, whereby a well potential is developed. Now, even if the electrifying bias is increased to raise the surface potential of the photosensitive member 21 from the potential V0 up to a potential V0', the exposed area potential will not depart largely from the potential Von. Hence, a toner density is determined only in accordance with the development bias Vb despite any small change in the electrifying bias.

Figure 16A:
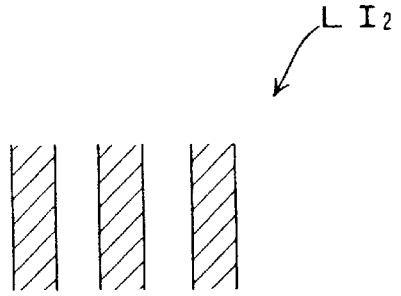
FIGS. 16A and 16B are drawings showing a relationship between the second patch images, a surface potential and a development bias potential.
Figure 16B:
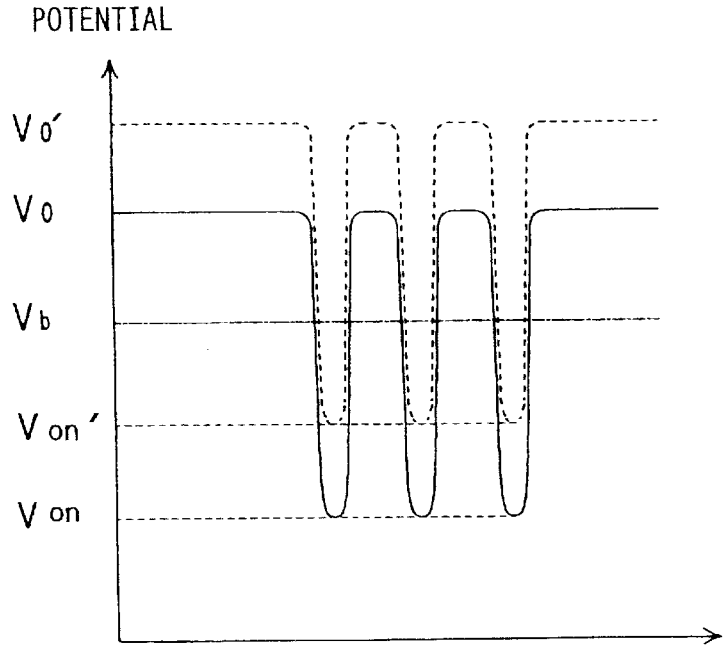

Meanwhile, a halftone image (second patch image) PI2 (See FIG. 14) contains line images formed at predetermined intervals. As an electrostatic latent image LI2 of the halftone image is formed on the surface of the photosensitive member 21 which is electrified uniformly at a surface potential V0, surface potentials corresponding to the positions of the lines largely drop down to the potential (exposed area potential) Von, as shown in FIGS. 16A and 16B. As a result, a comb-shaped well potential is developed. If the electrifying bias is increased in a similar manner to described above to raise the surface potential of the photosensitive member 21 from the potential V0 up to the potential V0', the exposed area potential corresponding to each line changes greatly from the potential Von to a potential Von'. Hence, as the electrifying bias changes, a toner density corresponding to the development bias Vb changes with the change in the electrifying bias. A relationship between such bias setup (the optimal development bias and the optimal electrifying bias) and a toner density will be described in detail in "C. Setting of Electrifying Bias in Development Bias Calculation" below.

From the above, it is found that use of a solid image reduces the influence of the electrifying bias over the toner density, and therefore, it is possible to adjust an image density of the solid image by means of adjustment of the development bias. In short, when the development bias calculation is executed using solid images as the first patch images as in the preferred embodiment above, it is possible to accurately calculate an optimal development bias regardless of the value of the electrifying bias.

Further, to form an image in a stable manner, adjustment at a maximum gradation (maximum density) alone is not sufficient. Density adjustment at a halftone gradation is necessary as well. However, when halftone images are used, as shown in FIGS. 16A and 16B, the set development bias and the set electrifying bias strongly influence an eventual image. To deal with this, the preferred embodiment above requires to calculate an optimal development bias first. While changing the electrifying bias with the development bias set to the optimal development bias, the second patch images of halftone images are formed. As a result, therefore, the optimal electrifying bias needed to obtain an image density which meets the target density is calculated.

C. Setting of Electrifying Bias in Development Bias Calculation

By the way, when second patch images are formed while changing an electrifying bias, a exposed area potential (bright part potential) Von of a latent image sometimes largely changes as the electrifying bias changes.

Figure 17:
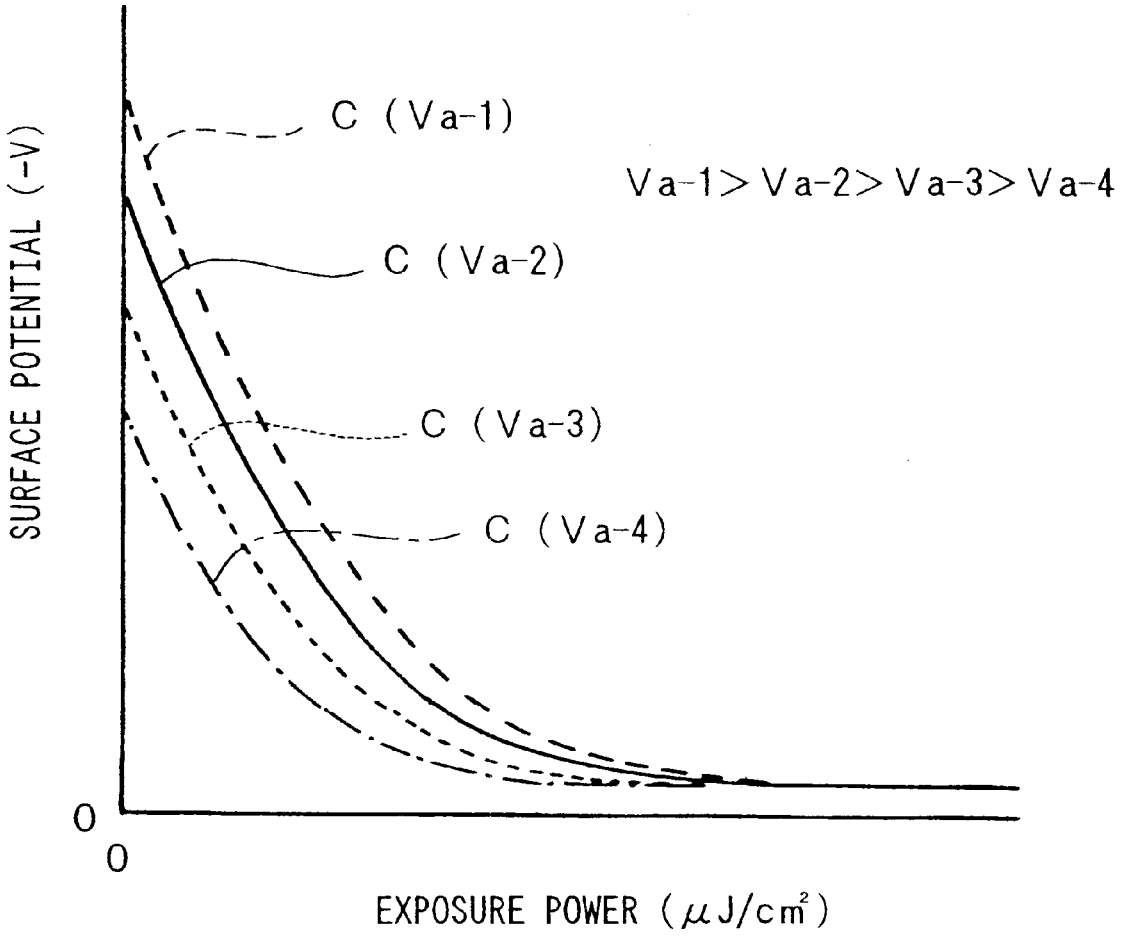
FIG. 17 is a graph showing attenuation of a surface potential as photosensitive member is exposed at various exposure powers.

FIG. 17 is a graph showing attenuation of a surface potential as a photosensitive member is exposed at various exposure powers, in which curves C(Va-1), C(Va-2), C(Va-3) and C(Va-4) express attenuation of a surface potential caused by electrification at electrifying biases Va-1 through Va-4 which are different from each other. In FIG. 17, "EXPOSURE POWER" denotes a dose of exposure applied upon a photosensitive member 21 per unit area from the exposure unit 3. As clearly shown in FIG. 17, a surface potential in a surface area of the exposed photosensitive member 21, namely, the exposed area potential changes in accordance with the electrifying bias and the exposure power supplied to the exposed photosensitive member 21 from the exposure unit 3. The exposed area potential is approximately the same between the attenuation curves regardless of a value of the electrifying bias when the exposure power is relatively large. On the other hand, the exposed area potential is different in accordance with the electrifying bias when the exposure power is relatively small. Such a tendency is as already described with reference to FIGS. 15A, 15B, 16A and 16B.

Hence, when the exposure power is set relatively high, even if the electrifying bias set during the development bias calculation is largely deviated from the optimal electrifying bias, a contrast potential (=development bias−surface potential) during the development bias calculation matches with a contrast potential after setting of the optimal electrifying bias. Therefore, it is possible to stably form an image at a target density by means of the optimal development bias and the optimal electrifying bias which are calculated according to the preferred embodiment above.

Conversely, when the exposure power is set relatively small, since the surface potential differs depending on the electrifying bias, it is sometimes impossible to stably form an image at a target density even despite setting the optimal development bias and the optimal electrifying bias which are calculated according to the preferred embodiment above. This is because when the electrifying bias set during the development bias calculation is largely deviated from the optimal electrifying bias, the contrast potential (=development bias−surface potential) during the development bias calculation becomes different from the contrast potential after setting of the optimal electrifying bias. With the contrast potential varied in such a manner, it is difficult to stabilize an image density.

Noting this, in a preferred embodiment described below, the electrifying bias is changed in accordance with a change in the development bias during the development bias calculation processing, to thereby solve the problem above which occurs when the exposure power is relatively small. First, a relationship between the development bias Vb and the contrast potential will be described before describing how the electrifying bias is specifically changed.

Figure 18:
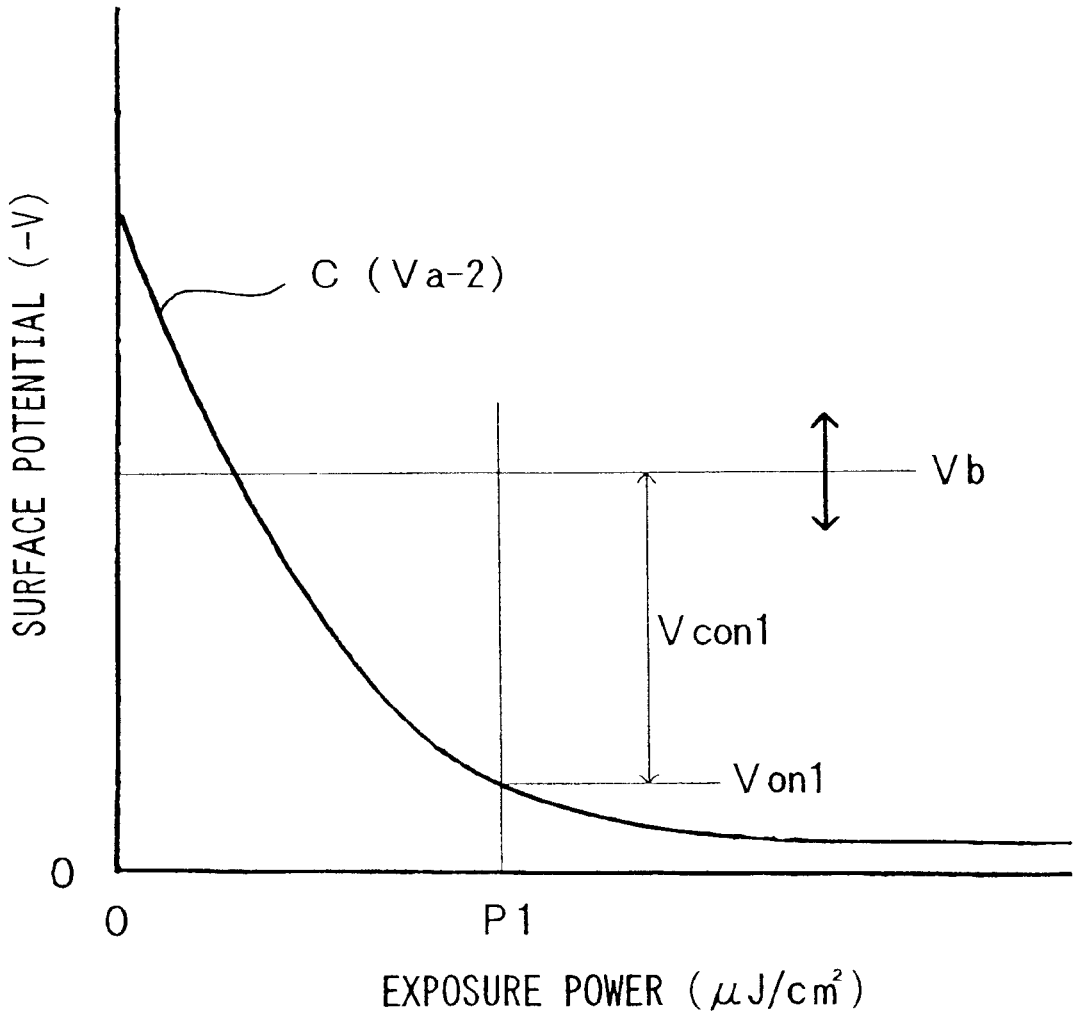
FIG. 18 is a drawing showing a relationship between a development bias and a contrast potential when the development bias is changed with an electrifying bias fixed.

During the development bias calculation processing, as shown in FIG. 18 for instance, if the electrifying bias is fixed at a bias Va-2 and latent images of first patch images are formed by exposing light at an exposure power P1, the exposed area potential of the latent images become a potential Von1. As the development bias Vb is changed in this condition, a contrast potential Vcon1 changes in accordance with the change in the development bias Vb, thereby changing densities of the first patch images. Hence, during the development bias calculation according to the preferred embodiment described above, a plurality of first patch images are formed while changing only the development bias Vb and the optimal development bias is thereafter determined.

Figure 19:
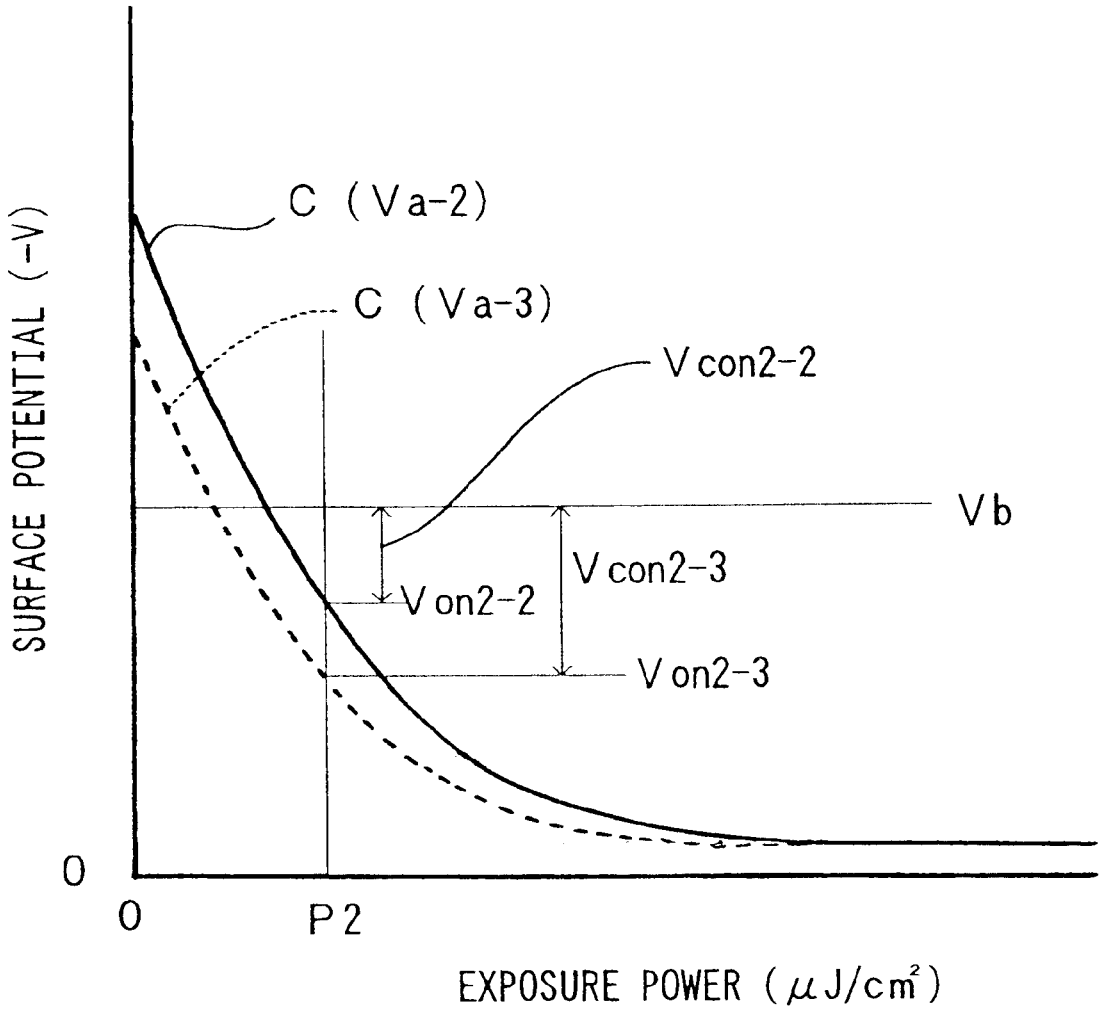
FIG. 19 is a drawing showing a relationship between an electrifying bias and a contrast potential when the electrifying bias is changed with a development bias fixed.

On the other hand, during the electrifying bias calculation processing, as shown in FIG. 19 for example, the electrifying bias is set to various levels while fixing the development bias to the optimal development bias Vb, and latent images of second patch images are formed by exposing light at an exposure power P2. The exposed area potential of the latent images becomes largely different between the different electrifying bias levels. Since second patch images are halftone images as those shown in FIG. 16A. Hence, even though the latent images are formed with an exposure beam having the exposure power P1, an effective exposure power for exposure with an isolated beam is smaller than the exposure power P1. As a result, the lowest potential level of a comb-shaped well potential is not as low as the lowest potential level which is observed during solid exposure. Noting a macro surface potential of a halftone latent image, this is the same as solid exposure at the exposure power P2 which is smaller than the exposure power P1. Therefore, considering that the latent images of the second patch images are images solidly exposed at the exposure power P2, the exposed area potential of these latent images becomes largely different depending on the electrifying bias.

For instance, the exposed area potential becomes a potential Von2-2 to generate the contrast potential Vcon2-2 when the electrifying bias has the level Va-2, whereas when the electrifying bias has the level Va-3, the exposed area potential becomes a potential Von2-3 to generate the contrast potential Vcon2-3. In this manner, the contrast potential Vcon2 changes as the electrifying bias Va changes, and a density of the second patch image accordingly changes. For this reason, the electrifying bias calculation according to the preferred embodiment described above requires to form a plurality of second patch images while changing only the electrifying bias Va in order to determine an optimal electrifying bias.

If the optimal electrifying bias resulting from such electrifying bias calculation processing is different from the electrifying bias set during the development bias calculation (i.e., the electrifying bias Va-2 in FIG. 18), the contrast potential Vcon1 determined through the development bias calculation is changed. Hence, despite application of the optimal development bias, an image density may deviate from a target density. The possibility of this is high particularly when the exposure power drops.

Figure 20:
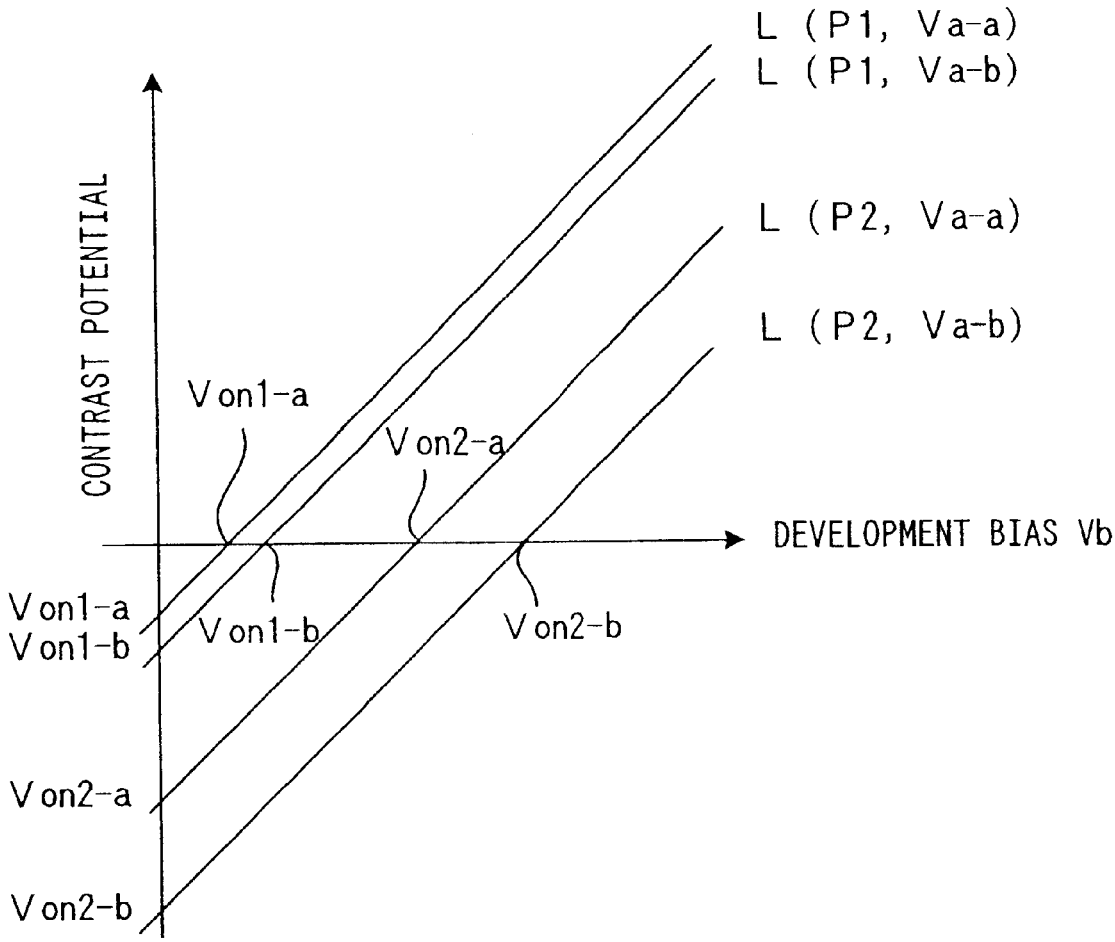
FIG. 20 is a drawing showing the relationship between the development bias and the contrast potential.

FIG. 20 shows a relationship between the development bias Vb and the contrast potential which is identified based on the optimal attenuation curves C(Va-a) and C(Va-b). In FIG. 20, the horizontal axis denotes the development bias Vb while the vertical axis denotes the contrast potential.

Figure 21:
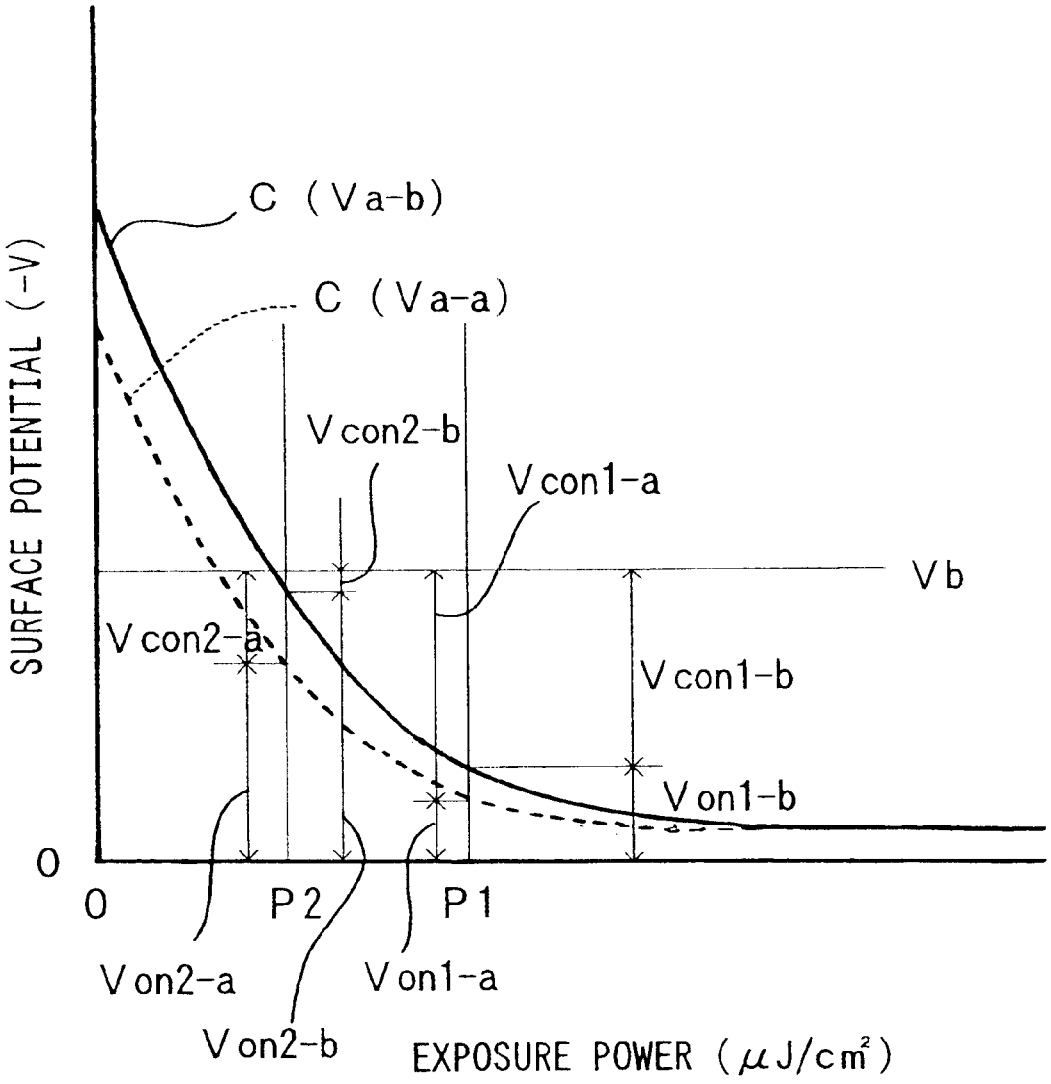
FIG. 21 is a drawing showing variations in the contrast potential and the exposed area potential in accordance with a change in the electrifying bias.

Further, straight lines L(P1, Va-a), L(P1, Va-b), L(P2, Va-a) and L(P2, Va-b) respectively denote contrast potentials Vcon1-a, Vcon1-b, Vcon2-a and Vcon2-b which are shown in FIG. 21.

When first patch images are formed with the electrifying bias Va-a, changing the development bias Vb causes proportional change in the contrast potential Vcon1-a as denoted at the straight line L(P1, Va-a) shown in FIG. 20. Meanwhile, when first patch images are formed with the electrifying bias Va-b, changing the development bias Vb causes proportional change in the contrast potential Vcon1-b as denoted at the straight line L(P1, Va-b) shown in FIG. 20. When second patch images are formed with the electrifying bias Va-a, changing the development bias Vb causes proportional change in the contrast potential Vcon2-a as denoted at the straight line L(P2, Va-a) shown in FIG. 20. Further, when second patch images are formed with the electrifying bias Va-b, changing the development bias Vb causes proportional change in the contrast potential Vcon2-b as denoted at the straight line L(P2, Va-b) shown in FIG. 20. A development bias/contrast potential characteristic is determined based on the optimal attenuation curves in this manner.

In FIG. 20, a target contrast potential Vcon01 corresponds to the target density during the development bias calculation processing and a target contrast potential Vcon02 corresponds to the target density during the electrifying bias calculation processing. In order to even more accurately adjust a density, it is necessary to set the optimal development bias Vb and the optimal electrifying bias Va such that these two contrast potentials Vcon01 and Vcon02 are simultaneously satisfied.

Figure 22:
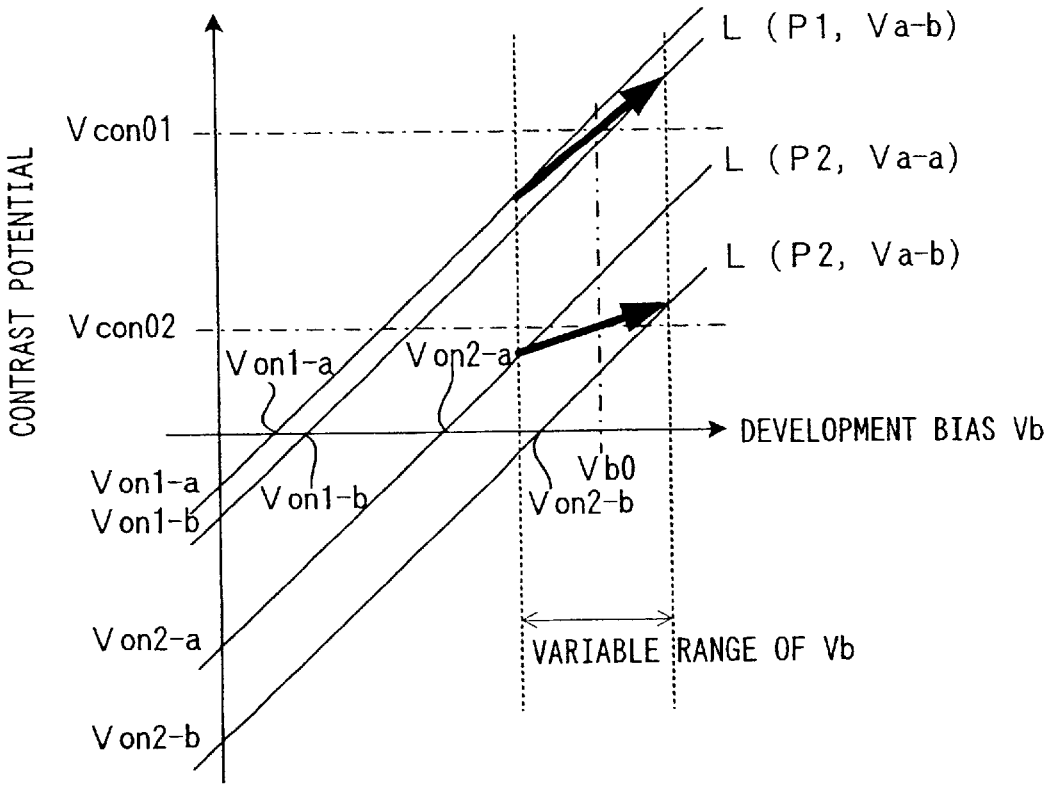
FIG. 22 is a drawing showing a relationship between the development bias and the contrast potential as the electrifying bias is set according to a first variation.

According to this embodiment, during the development bias calculation processing, as shown in FIG. 22, the development bias Vb is varied in its variable range while at the same time changing the electrifying bias from the level Va-a to the level Va-b. As the electrifying biases Va-a and Va-b are set so that the two target contrast potentials Vcon01 and Vcon02 are simultaneously satisfied with approximately the same development bias Vb0, the optimal development bias Vb and the optimal electrifying bias Va are set at a high accuracy.

Now, as variations of the electrifying bias during the development bias calculation processing, five variations will be described. In each one of the five variations below, the electrifying bias increases as the development bias increases.

Figure 23:
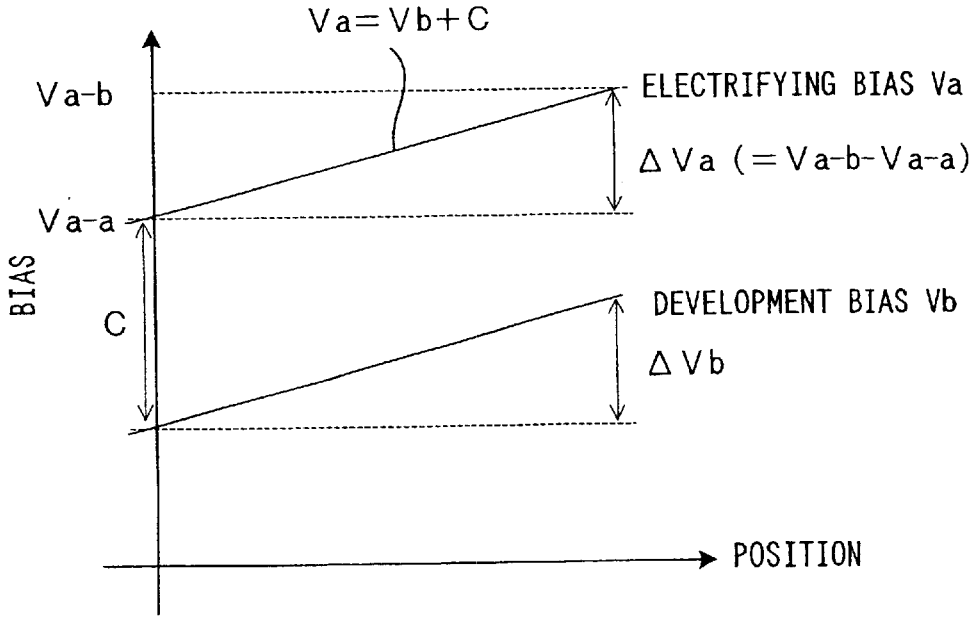
FIG. 23 is a drawing showing a relationship between the electrifying bias and the development bias in the first variation.
Figure 24:
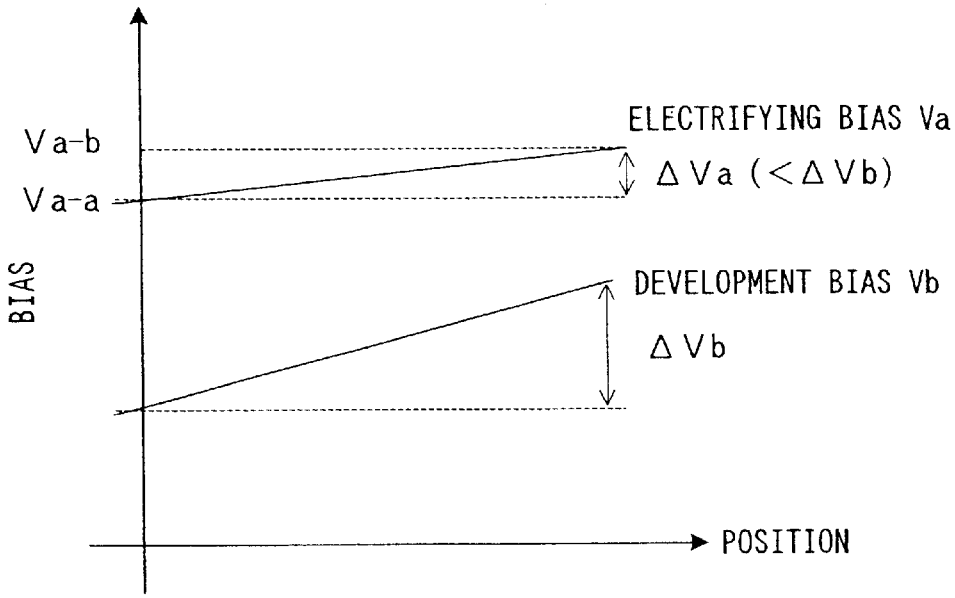
FIG. 24 is a drawing showing a relationship between the electrifying bias and the development bias in a second variation.

(1) First variation: FIG. 23

FIG. 23 is a drawing showing a first variation of the development bias and the electrifying bias during the development bias calculation processing. In the first variation, a quantity of change ΔVa (=Va-b−Va-a) in the electrifying bias is set equal to a quantity of change ΔVb in the development bias, and the electrifying bias Va is set to a value which is expressed as below:

$$Va=Vb+C$$

where C is a constant which is determined in accordance with a structure, operations and the like of an image forming apparatus.

Figure 29:
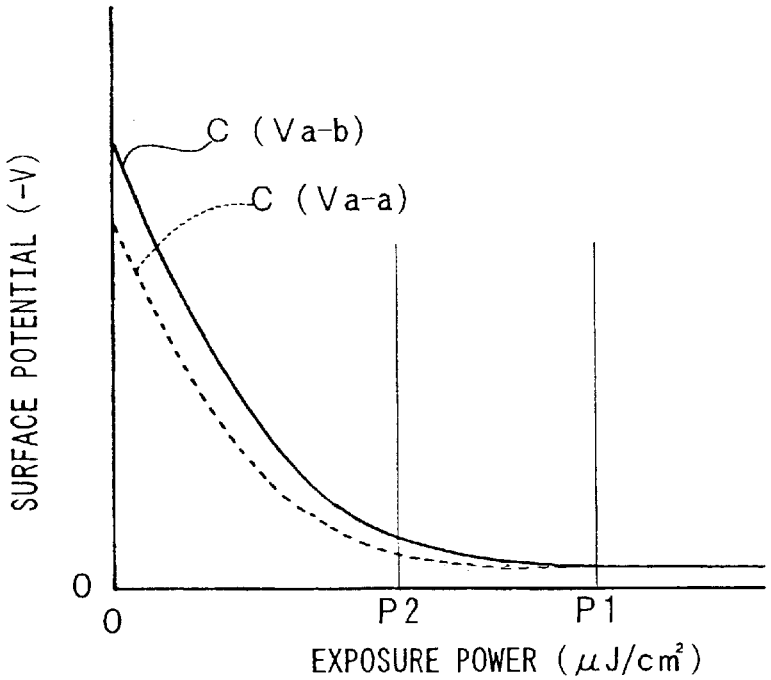
FIG. 29 is a drawing showing a relationship between an exposure power and a surface potential.

(2) Second variation: FIG. 29

Figure 25:
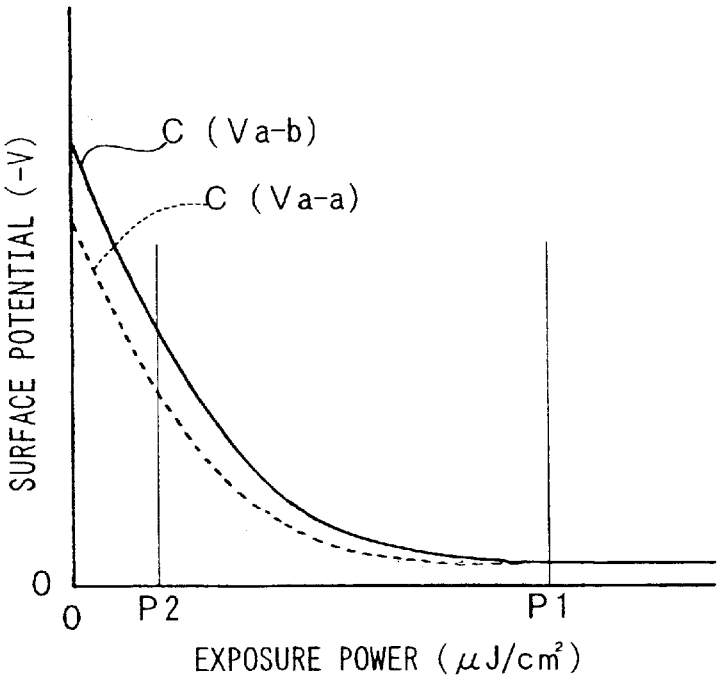
FIG. 25 is a drawing showing a relationship between an exposure power and a surface potential.
Figure 26:
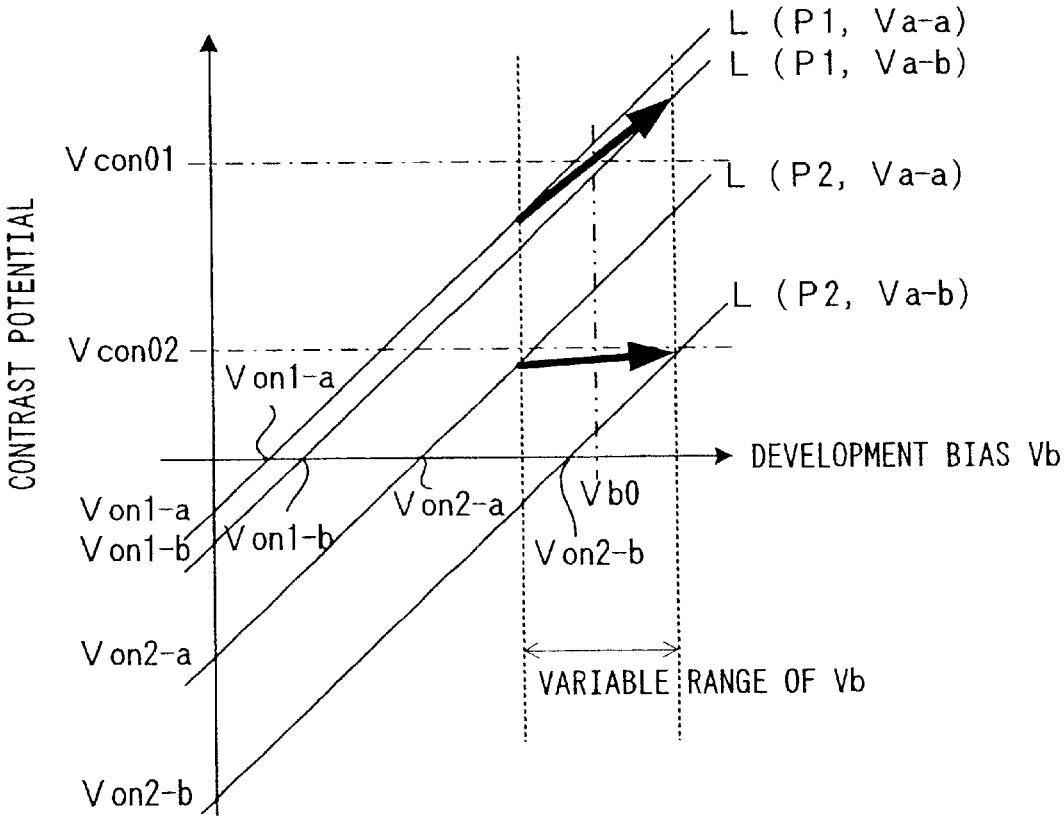
FIG. 26 is a drawing showing a relationship between the development bias and the contrast potential at the exposure power shown in FIG. 25.

FIG. 29 is a drawing showing a second variation of the development bias and the electrifying bias during the development bias calculation processing. In the second variation, a quantity of change ΔVa (=Va-b−Va-a) in the electrifying bias is set smaller than a quantity of change ΔVb in the development bias. Such setup is suitable to a situation where, as shown in FIG. 25, the exposure power P1 during the development bias calculation processing is relatively high thereby accompanying a small change in the exposed area potential Von1 with a change in the electrifying bias, whereas the exposure power P2 during the electrifying bias calculation processing is relatively low thereby accompanying a large change in the potential Von2 with a change in the electrifying bias. The reason of this will now be described with reference to FIGS. 25 through 27.

Where an attenuation characteristic is as shown in FIG. 25, the straight line L(P2, Va-a) and the straight line L(P2, Va-b) shown in FIG. 26 are apart relatively far from each other. Because of this, even when the electrifying bias is changed from the level Va-a to the level Va-b, the contrast potential Vcon2 shows only a small change, thereby making it impossible sometimes to calculate appropriate values which are necessary to obtain the target contrast potential Vcon02.

Figure 27:
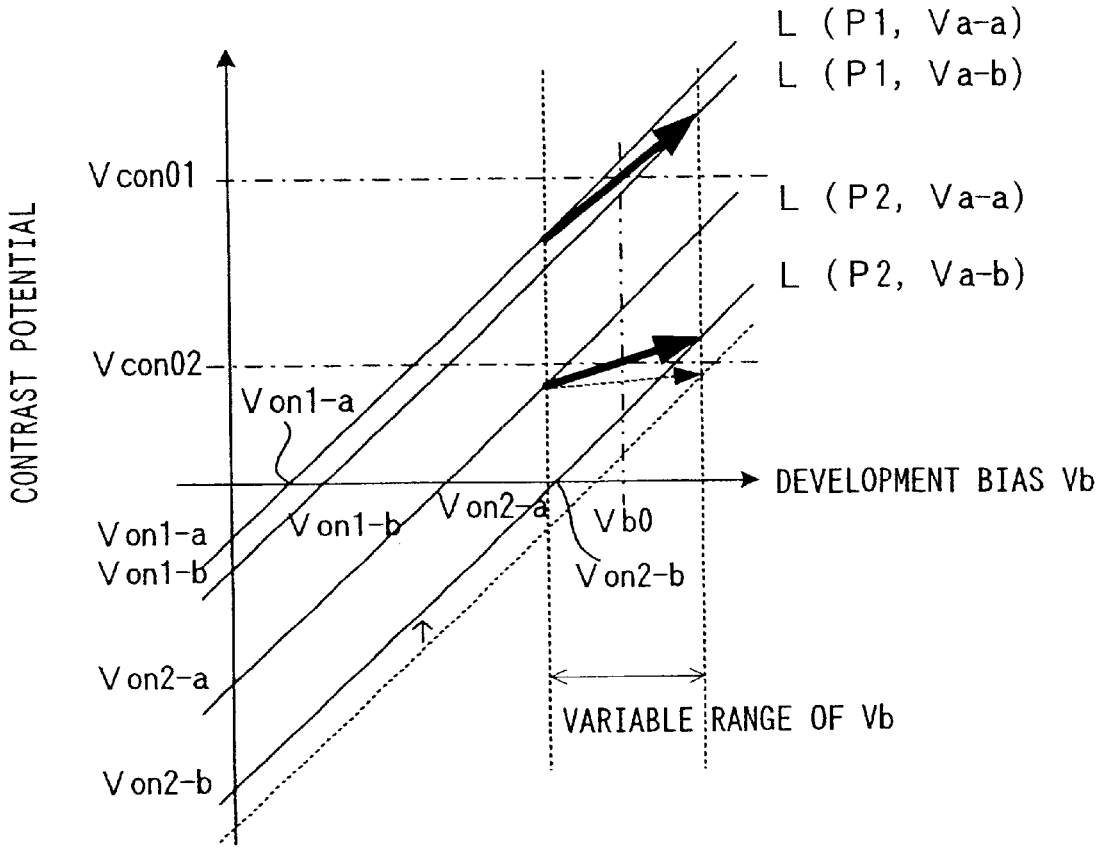
FIG. 27 is a drawing showing a relationship between the development bias and the contrast potential as the electrifying bias is set according to the second variation.

To deal with this, the second variation requires to set an electrifying bias change ΔVa smaller than a quantity of change ΔVb in the development bias Vb. Hence, the straight line L(P2, Va-b) shifts closer to the straight line L(P2, Va-a) as shown in FIG. 27, accompanying a large change in the contrast potential Vcon2. As a result, it is possible to reliably calculate appropriate values (the optimal development bias and the optimal electrifying bias) which are necessary to obtain the target contrast potential Vcon02.

Figure 28:
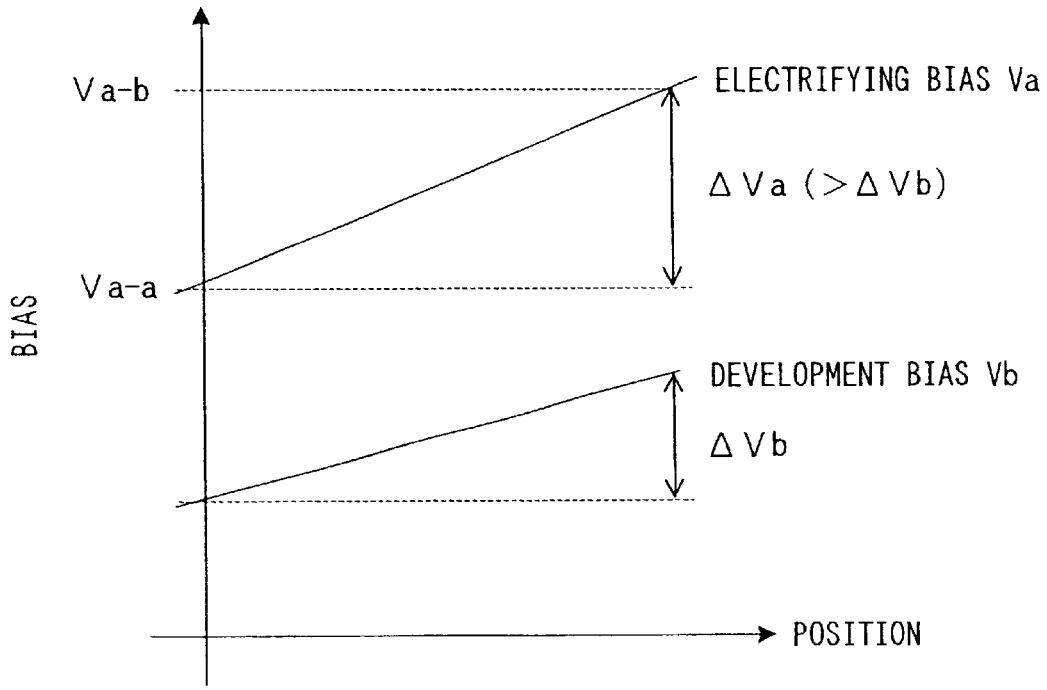
FIG. 28 is a drawing showing a relationship between the electrifying bias and the development bias in a third variation.

(3) Third variation: FIG. 28

Figure 30:
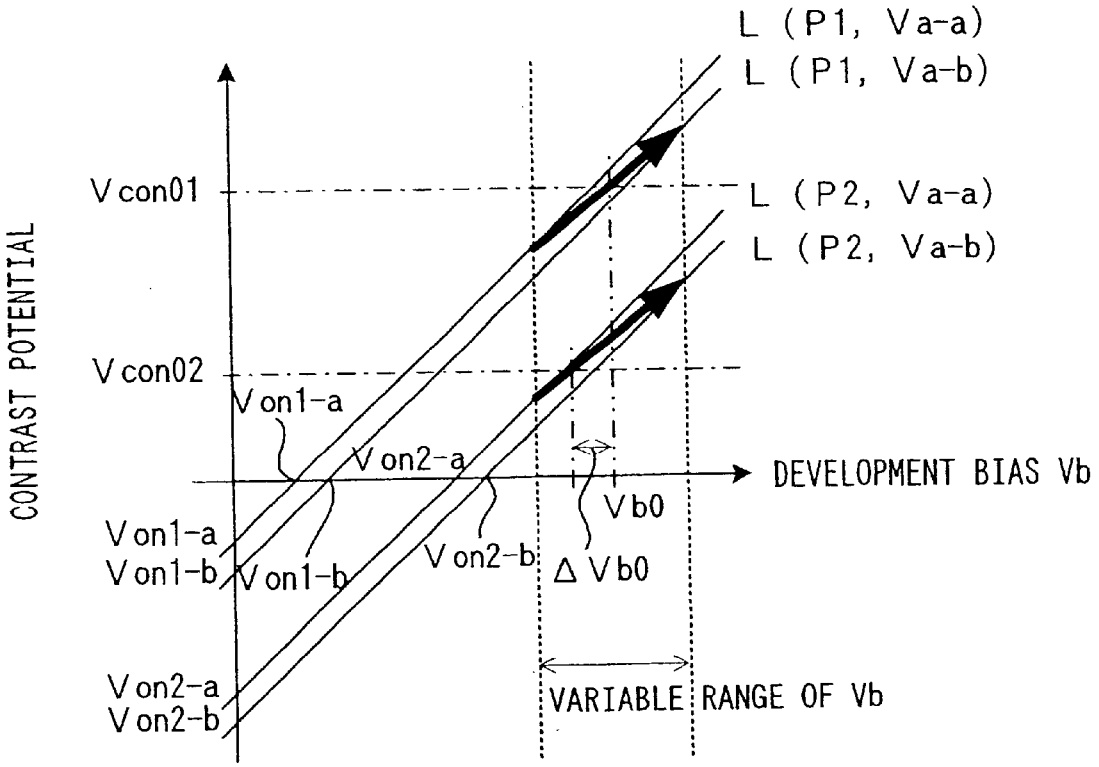
FIG. 30 is a drawing showing a relationship between the development bias and the contrast potential at the exposure power shown in FIG. 29.

FIG. 28 is a drawing showing a third variation of the development bias and the electrifying bias during the development bias calculation processing. In the third variation, a quantity of change ΔVa (=Va-b−Va-a) in the electrifying bias is set larger than a quantity of change ΔVb in the development bias. Such setup is suitable to a situation where, as shown in FIG. 29, the exposure power P1 during the development bias calculation processing is relatively high thereby accompanying a small change in the exposed area potential Von1 with a change in the electrifying bias, and the exposure power P2 during the electrifying bias calculation processing is also relatively high thereby accompanying a small change in the potential Von2 with a change in the electrifying bias. The reason of this will now be described with reference to FIGS. 29 through 31.

Where an attenuation characteristic is as shown in FIG. 29, the straight line L(P2, Va-a) and the straight line L(P2, Va-b) shown in FIG. 30 are apart relatively close to each other. In this condition, even when the electrifying bias is changed from the level Va-a to the level Va-b, the exposed area potentials Von2-a, Von2-b of second patch images shows only a small change, which arrives at virtually one optimal solution (the optimal electrifying bias). Because of this, as shown in FIG. 30, the target contrast potential Vcon01 of first patch images and the target contrast potential Vcon02 of second patch images sometimes become inconsistent to each other. In short, a deviation ΔVb0 is sometimes created between the optimal development bias Vb0 of first patch images and the optimal development bias of second patch images.

Figure 31:
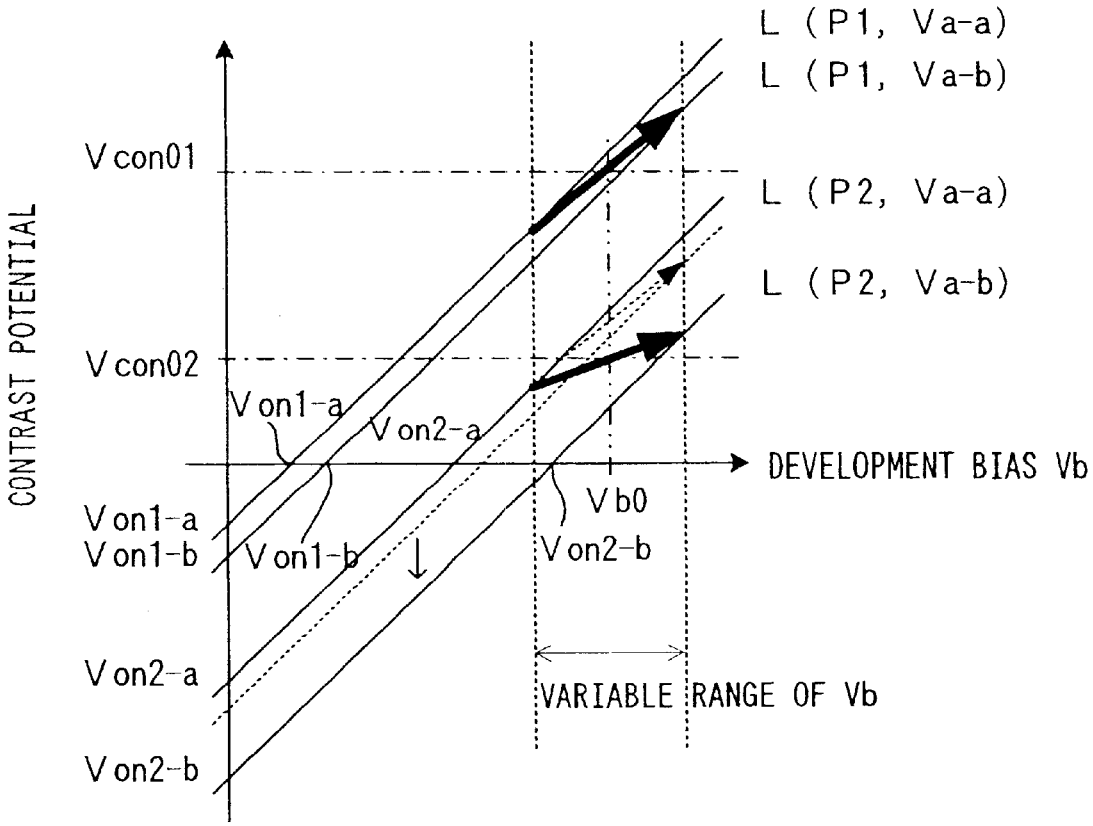
FIG. 31 is a drawing showing a relationship between the development bias and the contrast potential as the electrifying bias is set according to the third variation.

To deal with this, the third variation requires to set the electrifying bias change ΔVa larger than a quantity of change ΔVb in the development bias Vb (FIG. 28). Hence, the straight line L(P2, Va-b) is far from the straight line L(P2, Va-a) as shown in FIG. 31, thereby expanding a range of an optimal solution. This ensures consistency between the target contrast potential Vcon01 of first patch images and the target contrast potential Vcon02 of second patch images.

Figure 33:
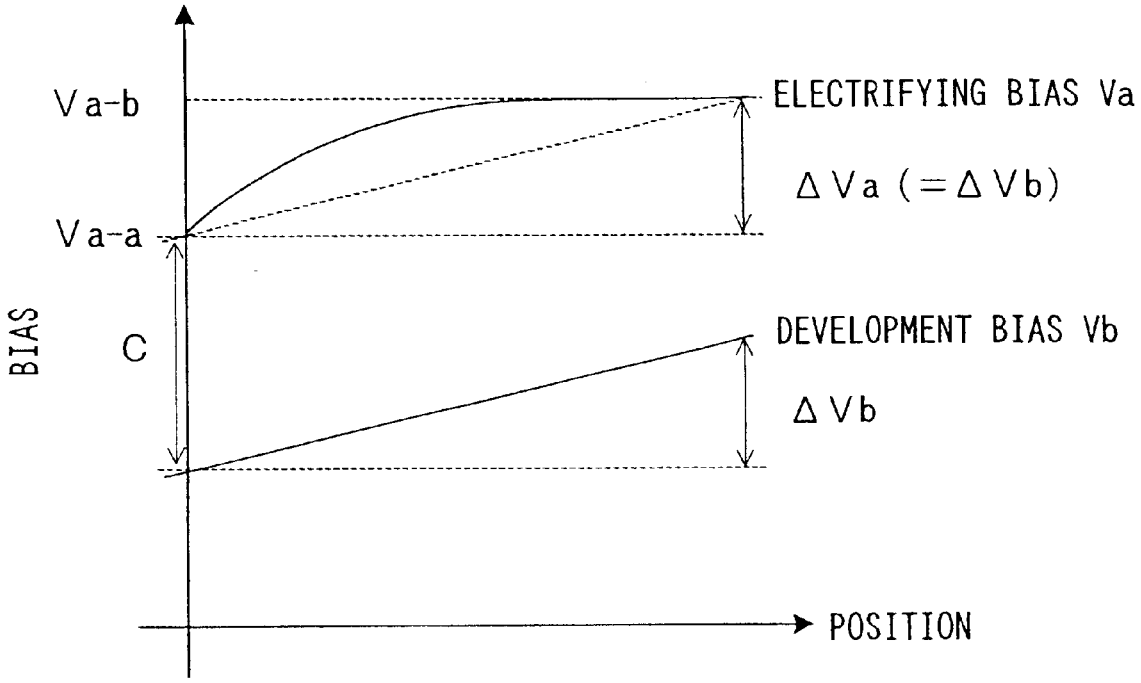
FIG. 33 is a drawing showing a relationship between the electrifying bias and the development bias in a fourth variation.

(4) Fourth variation: FIG. 33

Figure 32:
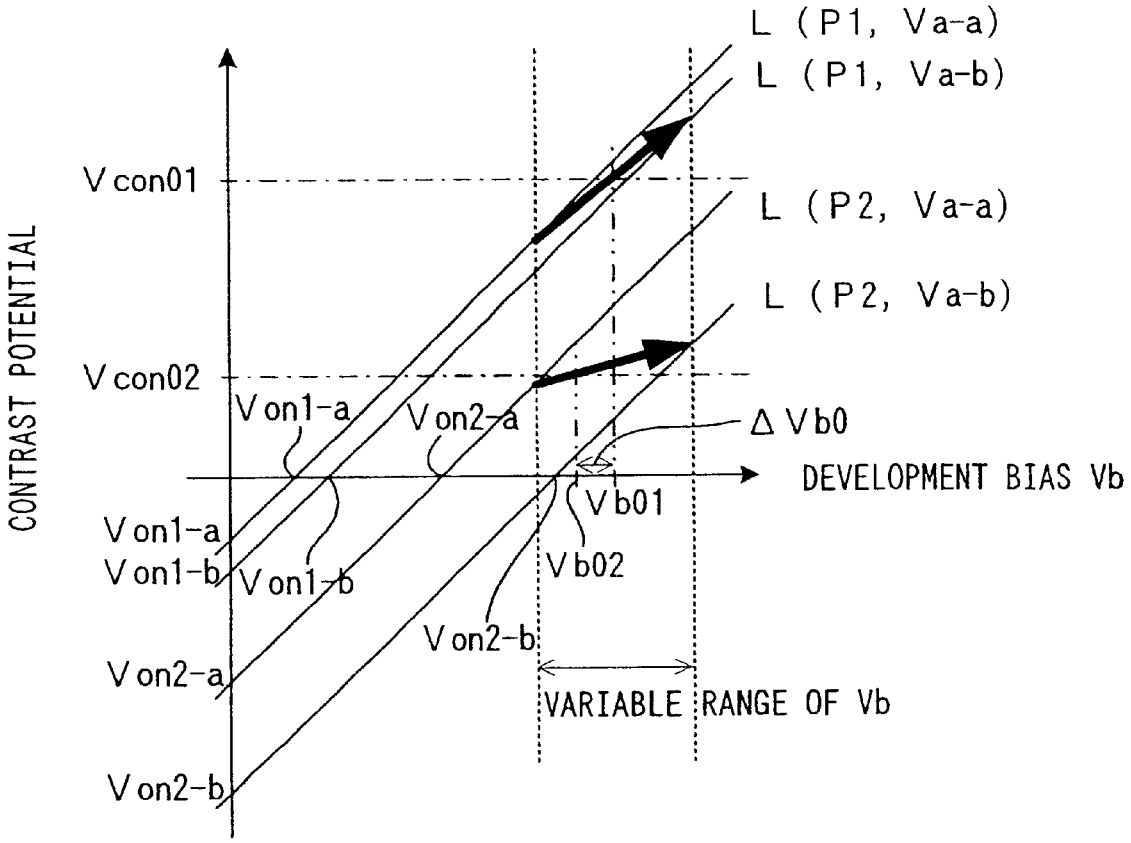
FIG. 32 is a drawing showing the relationship between the development bias and the contrast potential.
Figure 34:
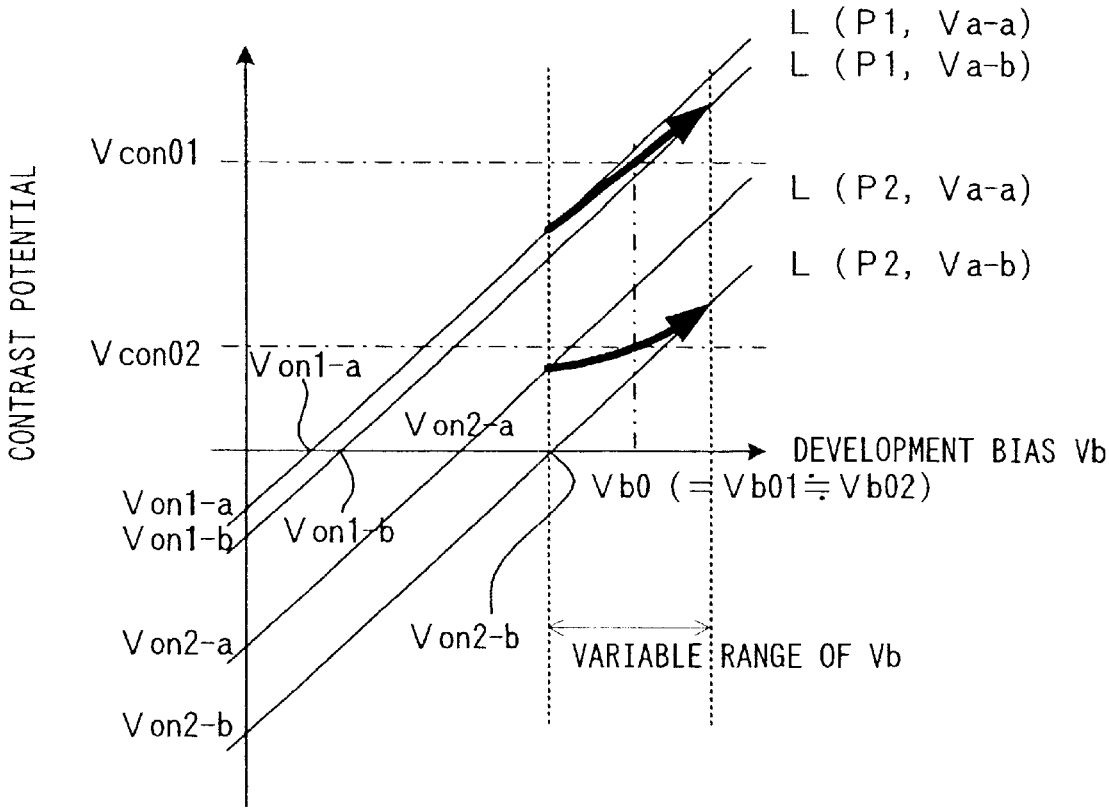
FIG. 34 is a drawing showing a relationship between the development bias and the contrast potential as the electrifying bias is set according to the fourth variation.

It is desirable to set the electrifying bias in accordance with a change in the development bias such that a development bias Vb01 satisfying the target contrast potential Vcon01 and a development bias Vb02 satisfying the target contrast potential Vcon02 become approximately equal to each other, as described above. However, depending on a process of forming images, as described earlier, it is difficult in some cases to match the development biases Vb01 and Vb02 with a linear change in the electrifying bias. For example, when the electrifying bias is changed according to the first variation (FIG. 23), the development bias Vb02 sometimes becomes smaller than the development bias Vb01 as shown in FIG. 32 to thereby create a deviation ΔVb0 to the development bias. When this occurs, the electrifying bias may be changed logarithmically as shown in FIG. 33, which moves the development bias Vb02 which satisfies the target contrast potential Vcon02 closer to the development bias Vb01 which satisfies the target contrast potential Vcon01 so that the two development biases Vb01 and Vb02 approximately match with each other (FIG. 34).

Figure 36:
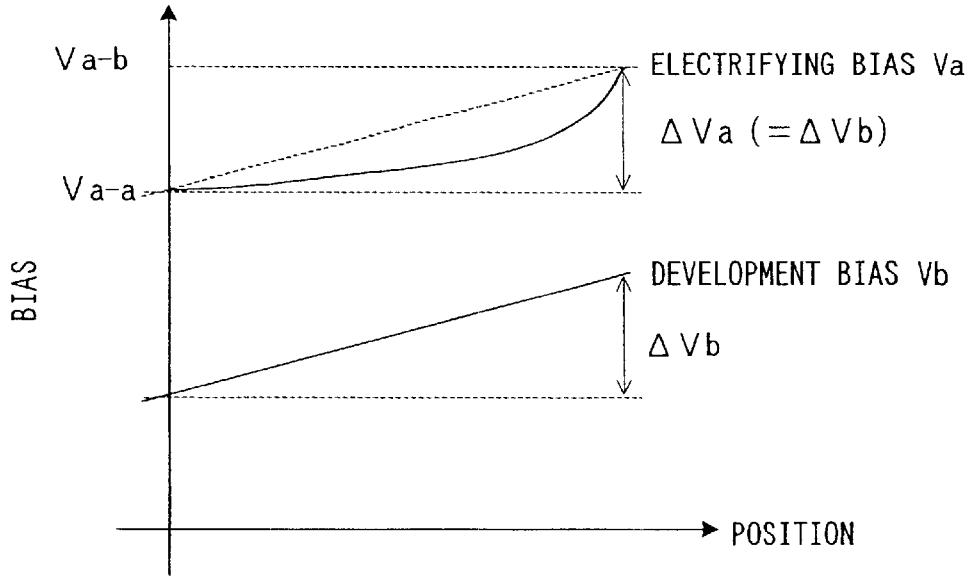
FIG. 36 is a drawing showing a relationship between the electrifying bias and the development bias in a fifth variation.

(5) Fifth variation: FIG. 36

Figure 35:
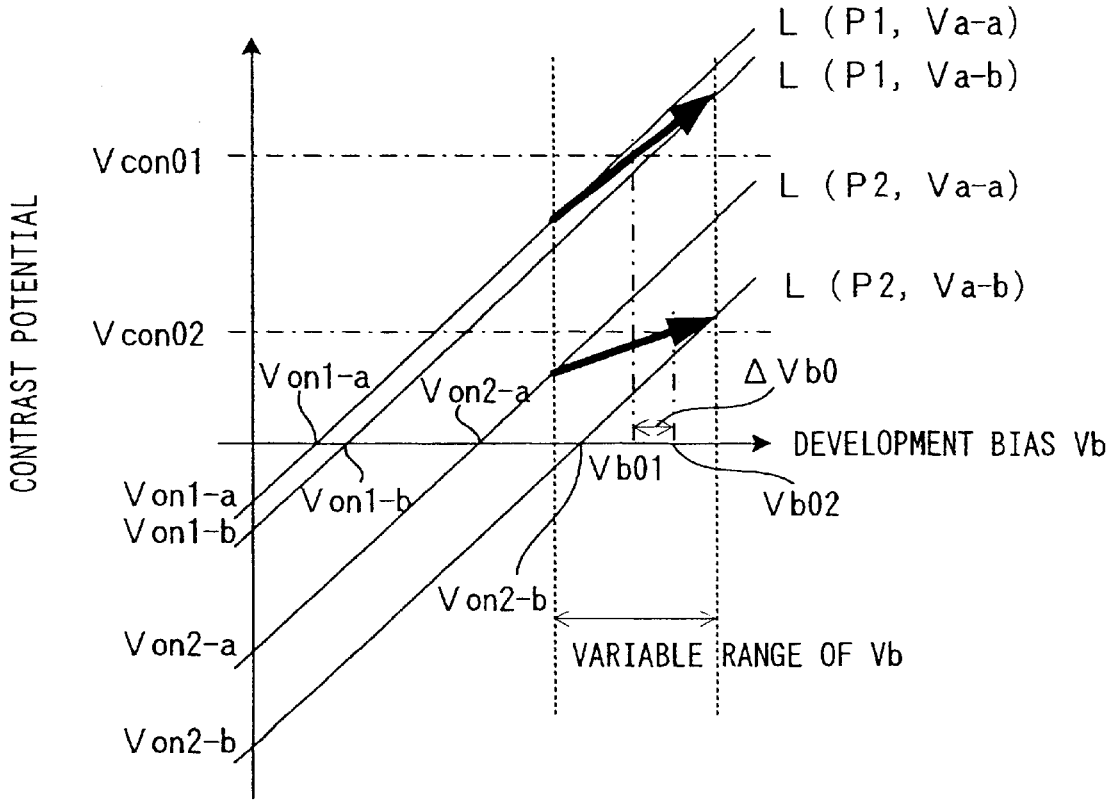
FIG. 35 is a drawing showing the relationship between the development bias and the contrast potential.
Figure 37:
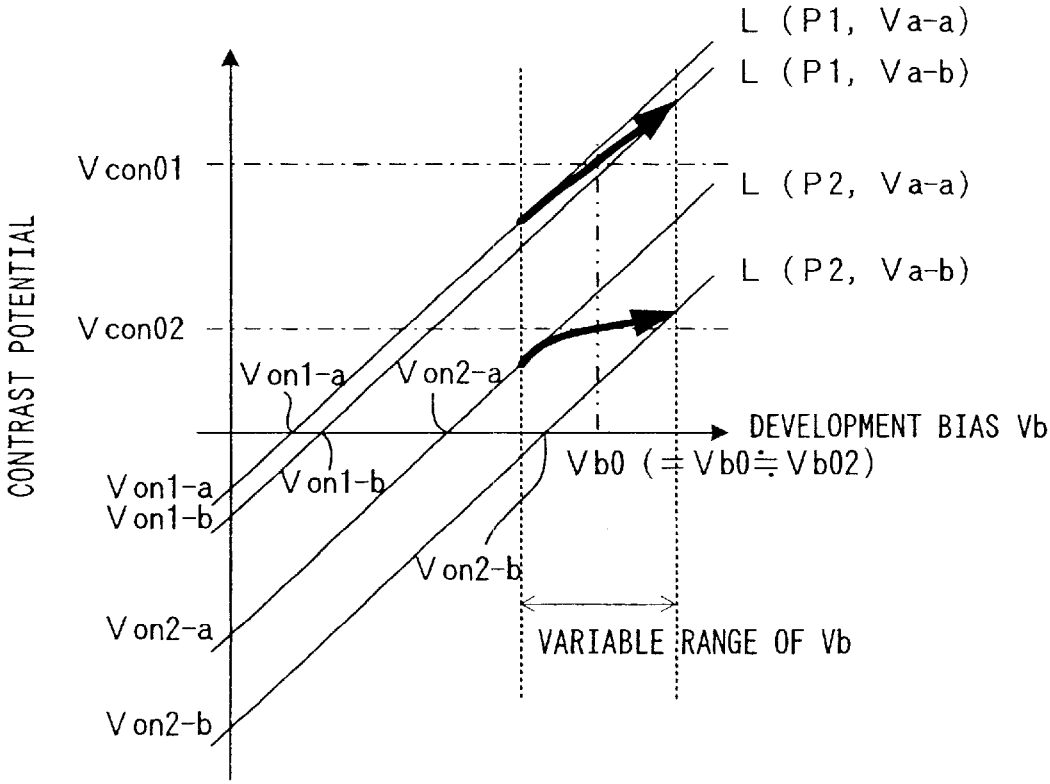
FIG. 37 is a drawing showing a relationship between the development bias and the contrast potential as the electrifying bias is set according to the fifth variation.
Figure 38A:
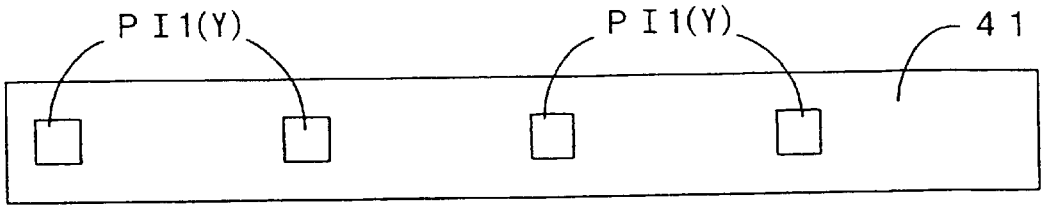
FIGS. 38A through 38D are drawings showing an order of forming patch images according to still other preferred embodiment.
Figure 38B:
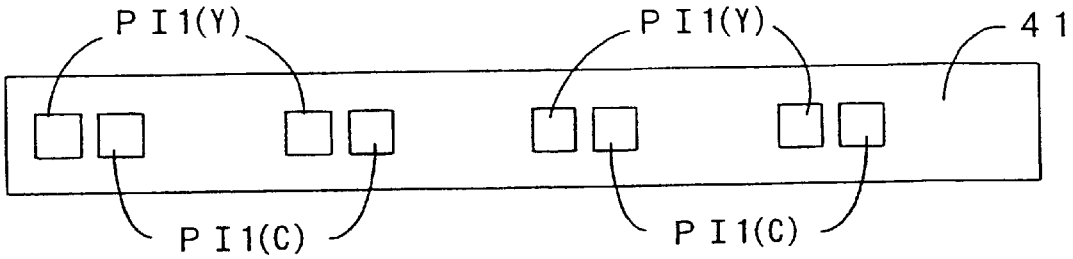
Figure 38C:
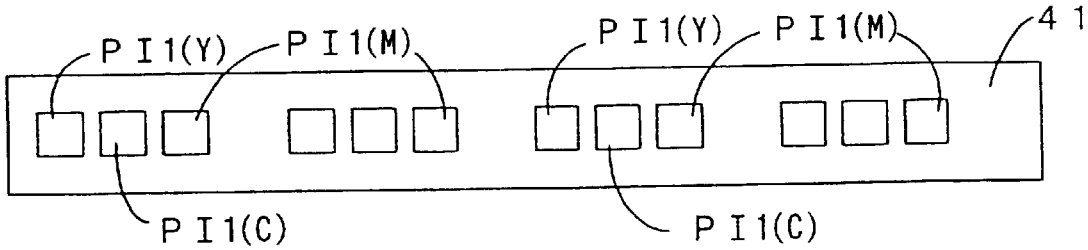
Figure 38D:
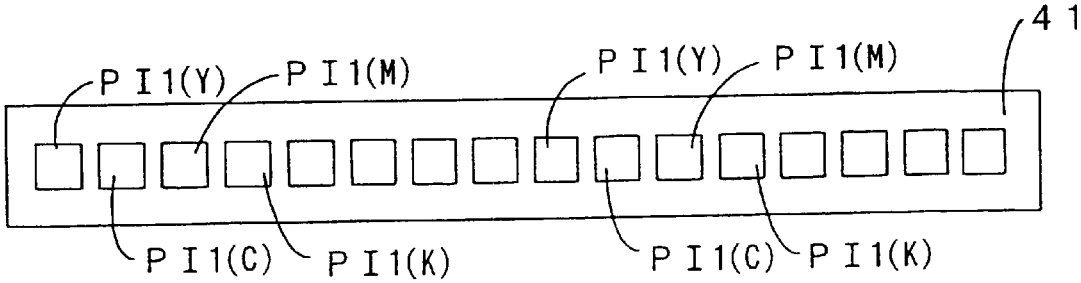

When the electrifying bias is changed according to the first variation (FIG. 23), the development bias Vb02 sometimes becomes larger than the development bias Vb01 as shown in FIG. 35, creating a deviation ΔVb0 to the development bias. When this occurs, the electrifying bias may be changed exponentially as shown in FIG. 36, which moves the development bias Vb02 which satisfies the target contrast potential Vcon02 closer to the development bias Vb01 which satisfies the target contrast potential Vcon01 so that the two development biases Vb01 and Vb02 approximately match with each other (FIG. 37).

The present invention is not limited to the preferred embodiment above, but can be modified in various manners other than those described above without departing from the essence of the present invention. For example, although the foregoing requires to use the electrifying roller 22 as the electrifying means, the present invention is applicable to an image forming apparatus in which non-contact electrifying means electrifies the photosensitive member 21.

Further, while the preferred embodiment above is related to an image forming apparatus which is capable of forming a color image using toners in four colors, an application of the present invention is not limited to this. The present invention is naturally applicable to an image forming apparatus which forms only a monochrome image as well. In addition, although the image forming apparatus according to the preferred embodiment above is a printer for forming an image supplied from an external apparatus such as a host computer through the interface 112 on a sheet such as a copying paper, a transfer paper, a form and a transparent sheet for an over-head projector, the present invention is applicable to image forming apparatuses of the electrophotographic method in general such as a copier machine and a facsimile machine.

Further, in the preferred embodiment above, toner images on the photosensitive member 21 are transferred onto the intermediate transfer belt 41, image densities of patch images formed by said toner images are detected, and an optimal development bias and an optimal electrifying bias are thereafter calculated based on the detected image densities. However, the present invention is also applicable to an image forming apparatus in which a toner image is transferred onto other transfer medium except for the intermediate transfer belt 41, to thereby form a patch image. The other transfer medium includes a transfer drum, a transfer belt, a transfer sheet, an intermediate transfer drum, an intermediate transfer sheet, a reflection-type recording sheet, a transmission memory sheet, etc. Further, instead of forming a patch image on a transfer medium, a patch sensor may be disposed so as to detect a density of a patch image which is formed on a photosensitive member. In this case, the patch sensor detects image densities of patch images on the photosensitive member and an optimal development bias and an optimal electrifying bias are calculated based on the detected image densities.

Further, in the preferred embodiment above, the RAM 127 of the engine controller 12 stores an optimal development bias and an optimal electrifying bias. Hence, when the main power source of the image forming apparatus is turned off, the contents stored in the RAM 127 disappear. When the main power source is turned on once again, the image forming apparatus recognizes the current development bias calculation and the current electrifying bias calculation as "the first" calculation and executes processing in accordance with this recognition. Instead of this, a nonvolatile memory such as an EEPROM may be used to store an optimal development bias and an optimal electrifying bias which are calculated in sequence, so that as the main power source is turned on once again, the processing for "the second or subsequent" calculation is executed during the development bias calculation and the electrifying bias calculation.

Further, the narrow range is defines as approximately ⅓ of the programmable range (Vb01–Vb10) of development bias in the preferred embodiment above. Although the width of the narrow range is not limited to this, if the width of the narrow range is wide, the use of the narrow range becomes less meaningful and degrades the accuracy of calculation of an optimal development bias. For this reason, it is necessary to set the narrow range as approximately ½ of or narrower than the programmable range for development bias. This also applies to the narrow range for electrifying biases as well.

Further, although the four types of biases are set in the wide and the narrow ranges in the preferred embodiment described above, the number of bias values (the number of patch images) in the range is not limited to this but may be optional to the extent that more than one types of bias values are used. Alternatively, the number of bias values may be different between the wide range and the narrow range such that the number of patch images is different between the wide range and the narrow range.

Further, while the first patch images are each a solid image whose area ration is 100% in the preferred embodiment above, an image whose area ratio is approximately 80% or more may be used instead of using a solid image. Even when such an image is used as the first patch images, a similar effect to that promised when solid images are used is obtained. The term "area ratio" refers to a ratio of dots to the area of a patch image as a whole.

Further, in the preferred embodiment above, after executing the development bias calculation (step S3), the electrifying bias calculation (step S5) is further executed, in order to calculate an optimal development bias and an optimal electrifying bias. However, the manner in which an optimal development bias and an optimal electrifying bias are calculated is not limited to this. For example, a plurality of patch images may be formed while changing the development bias and the electrifying bias at the same time, so that an optimal development bias and an optimal electrifying bias are calculated based on image densities of the patch images and density adjustment is executed. In this case, memory means such as a RAM and a ROM stores the development bias and the electrifying bias for every density adjustment and the memory means reads out the most recent development bias and the most recent electrifying bias in preparation for the next density adjustment. The plurality of patch images are formed while changing the development bias and the electrifying bias at the same time based on the most recent development bias and the most recent electrifying bias. This realizes a similar effect to that according to the preferred embodiment above. Still further, the present invention is applicable to where calculation of an optimal development bias is executed first and an optimal electrifying bias is thereafter calculated followed by density adjustment, in which case as well it is possible to achieve a similar effect to that described above.

Further, while the patch images PI1 are formed as clusters in each color as shown in FIGS. 8A through 8D in the preferred embodiment described above, the patch images PI1 may be formed in each color in turn as shown in FIGS. 38A through 38D. More specifically, first, yellow patch images PI1(Y) are formed on the intermediately transfer belt 41 at relatively wide intervals. Next, cyan patch images PI1(C) are formed one by one, starting at a position which is shifted by one patch image and a blank between the adjacent-patch images in the sub scanning direction (the right-hand side in FIGS. 38A through 38D) as viewed from the yellow patch images PI1(Y). Following this, magenta patch images PI1(M) and black patch images PI1(K) are formed in a similar manner. Where the respective patch images are thus formed at relatively wide intervals, it is possible to ensure a stabilization time for switching of the biases, and hence, to form the respective patch images at the set biases without fail. Although the description immediately above is related to first patch images, the same directly applies to second patch images as well.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus for forming an image which has a predetermined target density, comprising:

a photosensitive member;

electrifying means which electrifies a surface of said photosensitive member;

exposing means which forms an electrostatic latent image on the surface of said photosensitive member;

developing means which visualizes said electrostatic latent image with a toner and forms a toner image;

transferring means which transfers the toner image from said photosensitive member to a transfer medium;

density detecting means which detects an image density of the toner image on said photosensitive member or on said transfer medium as a patch image;

control means which controls an electrifying bias to be supplied to said electrifying means and a development bias to be supplied to said development means based on a result of the detection obtained by said density detecting means, and adjusts an image density of the toner image to a target density; and memory means which stores the electrifying bias and the development bias, wherein every time adjustment is finished, said control means causes said memory means to store the electrifying bias and the development bias which are obtained after the adjustment as an optimal electrifying bias and an optimal development bias, respectively, and when adjustment is performed repeatedly, based on said optimal electrifying bias and the optimal development bias stored in said memory means, said control means controls such that a plurality of patch images are formed in sequence while changing at least one of the electrifying bias and the development bias, wherein said control means is capable of changing the development bias within a predetermined programmable range of development bias, and said control means determines an optimal development bias which is needed to obtain the target density based on densities of first patch images which are formed in the following bias condition: the electrifying bias is set to said optimal electrifying bias which is stored in said memory means; and the development bias is gradually changed within a range which is approximately ½ of or narrower than the programmable range of development bias and yet includes the most recent optimal development bias which is stored in said memory means.

2. The image forming apparatus according to claim 1, wherein the area ratio of said first patch images is 80% or more.

3. The image forming apparatus according to claim 2, wherein said first patch images are solid images.

4. The image forming apparatus according to claim 1, wherein said control means is capable of changing the electrifying bias within a predetermined programmable range of electrifying bias, and said control means determines an optimal electrifying bias which is needed to obtain the target density based on densities of second patch images which are formed in the following bias condition: the development bias is set to the optimal development bias which is obtained based on densities of said first patch images; and the electrifying bias is gradually changing within a range which is approximately ½ of or narrower than the programmable range of electrifying bias and yet includes the most recent optimal electrifying bias which is stored in said memory means.

5. The image forming apparatus according to claim 4, wherein said second patch images are halftone images.

6. An image forming apparatus for forming an image which has a predetermined target density, comprising:

a photosensitive member;

electrifying means which electrifies a surface of said photosensitive member;

exposing means which forms an electrostatic latent image on the surface of said photosensitive member;

developing means which visualizes said electrostatic latent image with a toner and forms a toner image;

transferring means which transfers the toner image from said photosensitive member to a transfer medium;

density detecting means which detects an image density of the toner image on said photosensitive member or on said transfer medium as a patch image;

control means which controls an electrifying bias to be supplied to said electrifying means and a development bias to be supplied to said development means based on a result of the detection obtained by said density detecting means, and adjusts an image density of the toner image to a target density; and memory means which stores the electrifying bias and the development bias, wherein every time adjustment is finished, said control means causes said memory means to store the electrifying bias and the development bias which are obtained after the adjustment as an optimal electrifying bias and an optimal development bias, respectively, and when adjustment is performed repeatedly, based on said optimal electrifying bias and the optimal development bias stored in said memory means, said control means controls such that a plurality of patch images are formed in sequence while changing at least one of the electrifying bias and the development bias wherein said control means is capable of changing the electrifying bias within a predetermined programmable range of electrifying bias, and said control means determines an optimal electrifying bias which is needed to obtain the target density based on densities of third patch images which are formed in the following bias condition: the development bias is set to the optimal development bias which is stored in said memory means; and the electrifying bias is gradually changed within a range which is approximately ½ of or narrower than the programmable range of electrifying bias and yet includes the most recent optimal electrifying bias which is stored in said memory means.

7. The image forming apparatus according to claim 6, wherein said third patch images are halftone images.

8. An image forming method in which after an electrifying bias is applied to electrifying means to electrify a surface of a photosensitive member, an electrostatic latent image is formed on the surface of said photosensitive member, a development bias is applied to developing means so that said electrostatic latent image is visualized with a toner and a toner image is formed, said method comprising the steps of:

a first step in which after sequentially forming a plurality of toner images as patch images while changing at least one of the electrifying bias and the development bias, densities of said patch images are detected, and an optimal development bias and an optimal electrifying bias which are needed to obtain a target density are determined based on image densities of said patch images; and a second step of storing the optimal development bias and said optimal electrifying bias in memory means, wherein when said first step is to be repeated again after executing said second step, based on the most recent optimal development bias and the most recent optimal electrifying bias which are stored in said memory means, a plurality of patch images are formed in sequence while changing at least one of the electrifying bias and the development bias wherein, said first step comprises: a first sub step in which the electrifying bias is fixed at the most recent optimal electrifying bias which is stored in said memory means, and after sequentially forming a plurality of first patch images while changing the development bias based on the most recent optimal development bias which is stored in said memory means, densities of said first patch images are detected, and an optimal development bias which is needed to obtain a target density is determined based on the image densities of said first patch images, and wherein used as said first patch images at said first sub step are images whose the area ratio is 80% or more.

9. The image forming method according to claim 8, wherein said first patch images are solid images.

10. An image forming method in which after an electrifying bias is applied to electrifying means to electrify a surface of a photosensitive member, an electrostatic latent image is formed on the surface of said photosensitive member, a development bias is applied to developing means so that said electrostatic latent image is visualized with a toner and a toner image is formed, said method comprising the steps of:

a first step in which after sequentially forming a plurality of toner images as patch images while changing at least one of the electrifying bias and the development bias, densities of said patch images are detected, and an optimal development bias and an optimal electrifying bias which are needed to obtain a target density are determined based on image densities of said patch images; and a second step of storing the optimal development bias and said optimal electrifying bias in memory means, wherein when said first step is to be repeated again after executing said second step, based on the most recent optimal development bias and the most recent optimal electrifying bias which are stored in said memory means, a plurality of patch images are formed in sequence while changing at least one of the electrifying bias and the development bias, wherein said first step comprises: a first sub step in which the electrifying bias is fixed at the most recent optimal electrifying bias which is stored in said memory means, and after sequentially forming a plurality of first patch images while changing the development bias based on the most recent optimal development bias which is stored in said memory means, densities of said first patch images are detected, and an optimal development bias which is needed to obtain a target density is determined based on the image densities of said first patch images, and wherein said first step further comprises: a second sub step in which the development bias is fixed at the optimal development bias which is determined at said first sub step, and after sequentially forming a plurality of second patch images while changing the electrifying bias based on the most recent optimal electrifying bias which is stored in said memory means, densities of said second patch images are detected, and an optimal electrifying bias which is needed to obtain the target density is determined based on the image densities of said second patch images.

11. The image forming method according to claim 10, wherein halftone images are formed as said second patch images at said second sub step.

12. An image forming method in which after an electrifying bias is applied to electrifying means to electrify a surface of a photosensitive member, an electrostatic latent image is formed on the surface of said photosensitive member, a development bias is applied to developing means so that said electrostatic latent image is visualized with a toner and a toner image is formed, said method comprising the steps of:

a first step in which after sequentially forming a plurality of toner images as patch images while changing at least one of the electrifying bias and the development bias, densities of said patch images are detected, and an optimal development bias and an optimal electrifying bias which are needed to obtain a target density are determined based on image densities of said patch images; and a second step of storing the optimal development bias and said optimal electrifying bias in memory means, wherein when said first step is to be repeated again after executing said second step, based on the most recent optimal development bias and the most recent optimal electrifying bias which are stored in said memory means, a plurality of patch images are formed in sequence while changing at least one of the electrifying bias and the development bias, wherein said first step further comprises: a third sub step in which the development bias is fixed at the optimal development bias which is stored in said memory means, and after sequentially forming a plurality of second patch images while changing the electrifying bias based on the most recent optimal electrifying bias which is stored in said memory means, densities of said second patch images are detected, and an optimal electrifying bias which is needed to obtain the target density is determined based on the image densities of said second patch images.

13. The image forming method according to claim 12, wherein halftone images are formed as said second patch images at said third sub step.

14. An image forming apparatus for forming an image which has a predetermined target density, comprising:

a photosensitive member;

electrifying means which electrifies a surface of said photosensitive member;

exposing means which forms an electrostatic latent image on the surface of said photosensitive member;

developing means which visualizes said electrostatic latent image with a toner and forms a toner image;

transferring means which transfers the toner image from said photosensitive member to a transfer medium;

density detecting means which detects an image density of the toner image on said photosensitive member or on said transfer medium as a patch image;

control means which controls an electrifying bias to be supplied to said electrifying means and a development bias to be supplied to said development means based on a result of the detection obtained by said density detecting means, and adjusts an image density of the toner image to a target density; and memory means which stores the electrifying bias and the development bias, wherein every time adjustment is finished, said control means causes said memory means to store the electrifying bias and the development bias which are obtained after the adjustment as an optimal electrifying bias and an optimal development bias, respectively, and when density adjustment is performed repeatedly, based on the optimal electrifying bias and the optimal development bias which are obtained from the immediately preceding density adjustment and stored in memory means, patch images are sequentially formed while changing at least one of the electrifying bias and the development bias.

15. An image forming method in which after an electrifying bias is applied to electrifying means to electrify a surface of a photosensitive member, an electrostatic latent image is formed on the surface of said photosensitive member, a development bias is applied to developing means so that said electrostatic latent image is visualized with a toner and a toner image is formed, said method comprising the steps of:

a first step in which after sequentially forming a plurality of toner images as patch images while changing at least one of the electrifying bias and the development bias, densities of said patch images are detected, and an optimal development bias and an optimal electrifying bias which are needed to obtain a target density are determined based on image densities of said patch images; and a second step of storing the optimal development bias and said optimal electrifying bias in memory means, wherein when said first step is to be repeated again after executing said second step, based on the most recent optimal development bias and the most recent optimal electrifying bias which are stored in said memory means, a plurality of patch images are formed in sequence while changing at least one of the electrifying bias and the development bias, and when density adjustment is performed repeatedly, based on the optimal electrifying bias and the optimal development bias which are obtained from the immediately preceding density adjustment and stored in memory means, patch images are sequentially formed while changing at least one of the electrifying bias and the development bias.

16. The image forming method according to claim 15, wherein said first step comprises: a first sub step in which the electrifying bias is fixed at the most recent optimal electrifying bias which is stored in said memory means, and after sequentially forming a plurality of first patch images while changing the development bias based on the most recent optimal development bias which is stored in said memory means, densities of said first patch images are detected, and an optimal development bias which is needed to obtain a target density is determined based on the image densities of said first patch images.

17. The image forming method according to claim 15, wherein said patch images are toner images which are formed on the surface of said photosensitive member.

18. The image forming method according to claim 15, wherein said patch images are toner images which are obtained by transferring said toner images formed on the surface of said photosensitive member onto a transfer medium.

* * * * *